US010912156B2

(12) United States Patent
Liebert et al.

(10) Patent No.: US 10,912,156 B2
(45) Date of Patent: Feb. 2, 2021

(54) INDUCTION HEATING METHODS AND APPARATUS

(71) Applicant: Illinois Tool Works Inc., Glenview, IL (US)

(72) Inventors: Scott Liebert, Freedom, WI (US); Paul Verhagen, Appleton, WI (US); Anthony Salsich, Appleton, WI (US)

(73) Assignee: Illinois Tool Works Inc., Glenview, IL (US)

( * ) Notice: Subject to any disclaimer, the term of this patent is extended or adjusted under 35 U.S.C. 154(b) by 395 days.

(21) Appl. No.: 15/606,491

(22) Filed: May 26, 2017

(65) Prior Publication Data

US 2018/0343707 A1 Nov. 29, 2018

(51) Int. Cl.

| | |
|---|---|
| ***H05B 6/10*** | (2006.01) |
| ***H05B 6/40*** | (2006.01) |
| ***H05B 6/44*** | (2006.01) |

(52) U.S. Cl.

CPC ..... *H05B 6/101* (2013.01); *H05B 6/40* (2013.01); *H05B 6/44* (2013.01)

(58) Field of Classification Search

CPC . H05B 6/101; H05B 6/44; H05B 6/40; H05B 6/36

USPC ..... 219/643, 635, 645, 601–602, 607, 617, 219/637, 640, 660–663, 665–668, 672, 219/674–676; 336/206–209

See application file for complete search history.

(56) References Cited

U.S. PATENT DOCUMENTS

| | | | | |
|---|---|---|---|---|
| 2,933,584 | A | 4/1960 | Thielsch | |
| 6,229,126 | B1 * | 5/2001 | Ulrich | C21D 1/42 219/635 |
| 2004/0084443 | A1 | 5/2004 | Ulrich | |
| 2013/0341320 | A1 * | 12/2013 | Tailor | F16L 13/0272 219/643 |

FOREIGN PATENT DOCUMENTS

| | | |
|---|---|---|
| AT | 510265 | 3/2012 |
| EP | 0589087 | 3/1994 |
| WO | 2006067728 | 6/2006 |
| WO | 2006088067 | 8/2006 |
| WO | 2012094765 | 7/2012 |

OTHER PUBLICATIONS

Int'l Search Report and Written Opinion PCT/US2018/034082 dated Aug. 29, 2018 (13 pgs).

(Continued)

*Primary Examiner* — Quang T Van

(74) *Attorney, Agent, or Firm* — McAndrews, Held & Malloy, Ltd.

(57) ABSTRACT

Methods and apparatus for induction heating are disclosed. An example induction heating apparatus includes a first conductor and a second conductor, configured to be arranged in conformance with a workpiece while the conductors are not electrically connected in series, and a turn connector configured to: connect the first and second conductors in series to configure the first and second conductors as an inductor having a plurality of turns; and arranges portions of the first and second conductors located between the turn connector and the workpiece to be adjacent.

20 Claims, 15 Drawing Sheets

(56) References Cited

OTHER PUBLICATIONS

Int'l Search Report and Written Opinion for Appln. No. PCT/US2018/034122 dated Oct. 31, 2018 (17 pgs).
Non-Final Office Action U.S. Appl. No. 15/606,537 dated Jul. 5, 2019.
Response to Non-Final Office Action, U.S. Appl. No. 15/606,537, dated Oct. 7, 2019.
Final Office Action U.S. Appl. No. 15/606,537 dated Nov. 21, 2019.
European examination report Appln No. 18731648.4 dated Nov. 17, 2020.

* cited by examiner

INDUCTION HEATING METHODS AND APPARATUS

BACKGROUND

This disclosure relates generally to welding-type systems, and more particularly to induction heating methods and apparatus.

Induction heating is a method for producing heat in a localized area on a susceptible metallic object. Induction heating involves applying an AC electric signal to a heating loop or coil placed near a specific location on or around the metallic object to be heated. The varying or alternating current in the loop creates a varying magnetic flux within the metal to be heated. Current is induced in the metal by the magnetic flux, thus heating it. Induction heating may be used for many different purposes including curing adhesives, hardening of metals, brazing, soldering, and other fabrication processes in which heat is a necessary or desirable agent.

SUMMARY

Methods and systems are provided for induction heating methods and apparatus, substantially as illustrated by and described in connection with at least one of the figures, as set forth more completely in the claims.

BRIEF DESCRIPTION OF THE DRAWINGS

The figures are not necessarily to scale. Where appropriate, similar or identical reference numbers are used to refer to similar or identical components.

DETAILED DESCRIPTION

Figure 1:
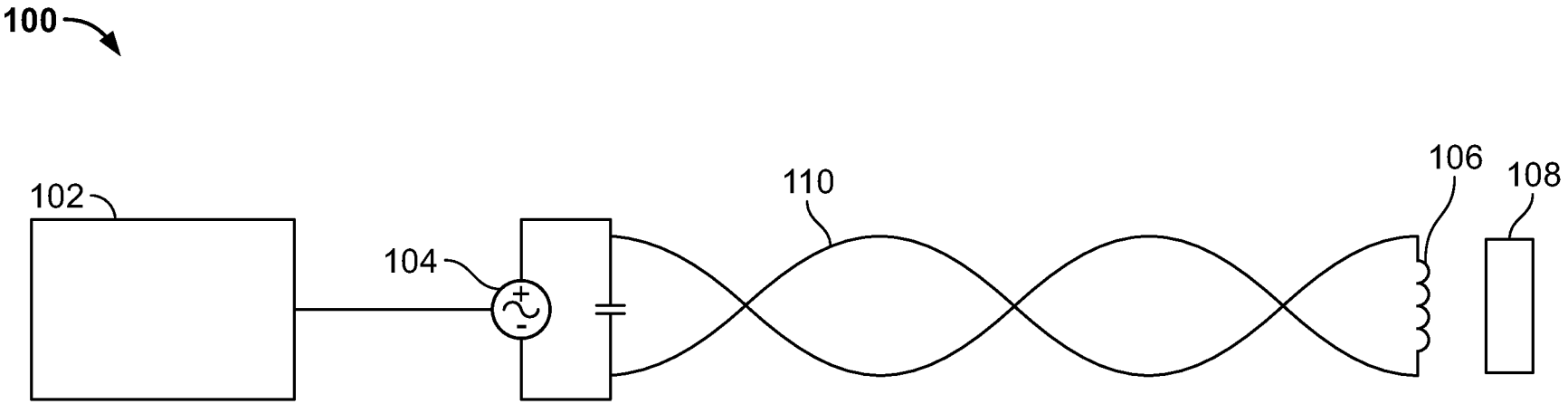
FIG. 1 shows an exemplary induction heating system, in accordance with aspects of this disclosure.

Induction heating is often used to heat workpieces prior to welding or brazing. For instance, pipes joints may be preheated prior to joining the pipe via welding. Conventional devices for heating pipe include fixed diameter heating tools, which require the user to have multiple, differently sized heating tools to perform heating operations on pipes of different diameters. Other conventional devices for heating pipe include lengths of heating cable, which require an operator to be trained for effective use. Additionally, the use of a heating cable may require wrapping the cable around the workpiece in the desired configuration, which requires operator time and reduces welding production.

Disclosed example induction heating methods and apparatus include a portable induction heating tool which is flexible and can accommodate multiple pipe diameters. The heating tool eliminates the need to apply custom induction cable wraps and significantly simplifies induction heating tool installations, so that the application of field induction heating does not require a third party contractor or extensive operator training.

Disclosed example induction heating methods and apparatus are flexible to enable use on workpieces of different sizes (e.g., pipes of different diameters). Thus, disclosed examples reduce or eliminate the need for diameter specific tools, reducing the number and/or investment in tooling required to heat pipes of different diameters.

Disclosed example induction heating methods and apparatus are flexible and easier to install and use than conventional heating cables. A single induction heating assembly may be used to heat workpieces within a range of sizes, and does not require the operator to have an advanced understanding of induction heating requirements to effectively operate. Disclosed example induction heating methods and apparatus enable fast installation by requiring only a single wrap around the workpiece to achieve multiple turns of a multi-turn helical coil. By extending around the workpiece, disclosed helical coil designs improve power transfer efficiencies over conventional pancake style heating blankets without requiring additional operator setup time. The ease and speed of installation improves the productivity of welders by reducing the time required for preheating a workpiece.

Disclosed example induction heating methods and apparatus may be less expensive than even a single conventional fixed diameter heating fixture. The necessity of having multiple conventional fixed diameter heating fixtures available for multiple workpiece sizes enhances the cost savings that may be achieved using example induction heating methods and apparatus.

As used herein the term "induction heating blanket" refers to an apparatus that includes conductors for conducting induction heating current, in a state capable of installation on a workpiece but not necessarily including attachment or installation hardware such as clamps or connectors. For example, a set of conductors and an outer insulation or protection cover is referred to herein as a blanket.

As used herein, the term "induction heating assembly" includes an induction heating blanket and any clamps or conductors used for installation on a workpiece. For example, an induction heating assembly may include an induction heating blanket (e.g., including conductors and an outer insulation and/or protection cover), a turn connector to connect multiple separate conductors in series to form multiple turns of an induction coil, and a clamp to physically secure the blanket in place. However, induction heating assemblies may include additional or alternative components.

As used herein, the terms "conform" and "conformance" refer to the physical matching of a physical shape by another object. For example, a conductor that is conformable is capable of flexibility or other deformation so as to match the physical shape of an object, such as a pipe, at least within a range of flexibility or deformation (e.g., not more than a threshold angle or not having less than a threshold radius of curvature).

Disclosed example induction heating apparatus include a first conductor and a second conductor, which are configured to be arranged in conformance with a workpiece while the conductors are not electrically connected in series, and a turn connector to connect the first and second conductors in series to configure the first and second conductors as an inductor having a plurality of turns. The turn connector further arranges portions of the first and second conductors located between the turn connector and the workpiece to be adjacent.

Some example induction heating apparatus further include an adjustment clamp to conform the first conductor and the second conductor to the workpiece. In some examples, the adjustment clamp secures corresponding first points along the first conductor and the second conductor to corresponding second points along the first conductor and the second conductor, and enables adjustment of the first points along lengths of the first conductor and the second conductor and/or adjustment of the second points along the lengths of the first conductor and the second conductor. In some examples, the locations of the first points and the second points determine lengths of the first conductor and the second conductor that can be conformed to the workpiece while securing the first points to the second points. In some such examples, the adjustment clamp enables the adjustment of the first points or the adjustment of the second points while the first points and the second points are not secured.

In some examples, the turn connector includes a first connector connected to a first end of the first conductor and a first end of the second conductor, and a second connector connected to a second end of the first conductor and a second end of the second conductor. When the first connector and the second connector are attached, the turn connector connects the second end of the first conductor to a first end of the second conductor to place the first conductor and the second conductor in series. In some such examples, the first connector routes the first conductor at least partially in a lateral direction toward the second conductor.

In some example induction heating apparatus, the turn connector couples a first set of two or more conductors, including the first conductor, in parallel with each other to form a first one of the plurality of turns. In some such examples, the turn connector couples a second set of two or more conductors, including the second conductor, in parallel with each other and in series with the first set of conductors. In some examples, the turn connector couples the first and second conductors to a power supply.

In some examples, the turn connector couples the first and second conductors such that current flows through the first and second conductors in a same direction. In some example induction heating apparatus, a third conductor is arranged in conformance with the workpiece to form a third turn of the inductor, in which the turn connector connects the third conductor to the second conductor to place the third turn in series with the first and second turns.

Some example induction heating apparatus further include a conductor holder to hold the first conductor and the second conductor such that the first conductor and the second conductor are arranged simultaneously with the conductor holder in conformance with the workpiece. In some such examples, the conductor holder includes; a jacket to insulate the first conductor and the second conductor from the workpiece; a cable clasp configured to hold the first conductor within a range of distances from the second conductor; and/or a clamp configured to hold the first conductor at a first position relative to the second conductor. In some examples, the conductor holder includes a removable jacket into which the first and second conductors can be removably inserted. In some examples, the conductor holder provides a substantially constant spacing between the plurality of turns. In some examples, the conductor holder holds the first conductor and the second conductor a substantially constant distance from the workpiece.

Some example induction heating apparatus further include an induction heating power supply to provide induction heating power to the plurality of turns. In some examples, the first and second conductors are arranged in conformance with an exterior surface of the workpiece or an interior surface of the workpiece. In some examples, the first conductor is a first Litz cable and the second conductor is a second Litz cable. Some examples further include an extension connector to connect the first and second conductors to corresponding ones of a second set of conductors to extend a length of the induction heating apparatus.

FIG. 1 illustrates an example induction heating system 100. The induction heating system 100 includes a control circuit 102 configured to control an induction heating power supply 104. The induction heating system 100 is configured to provide power from the induction heating power supply 104 to an induction heating coil 106 (e.g., an induction heating blanket, an induction heating assembly). The induction heating coil 106 is magnetically coupled to a workpiece 108 that is to be heated via the induction heating coil 106. In operation, the induction heating power supply 104 outputs power to the induction heating coil 106 at a heating frequency, which transfers the power to the workpiece 108 to inductively heat the workpiece 108. As illustrated in FIG.

1, the induction heating power supply 104 may be coupled to the induction heating coil 106 via an extension cable 110.

As described in more detail below, an example induction heating coil 106 includes two or more conductors and a turn connector. The conductors (and, by extension, the induction heating coil 106) may be conformably wrapped around the workpiece 108 while the conductors are not electrically connected in series. The turn connector connects the two or more conductors in series to configure the first and second conductors as an inductor having two or more turns. The example induction heating coil 106 may include one or more electrical and/or thermal insulators to, for example, prevent short circuiting and/or protect the conductors from heat induced in the workpiece 108.

Figure 2:
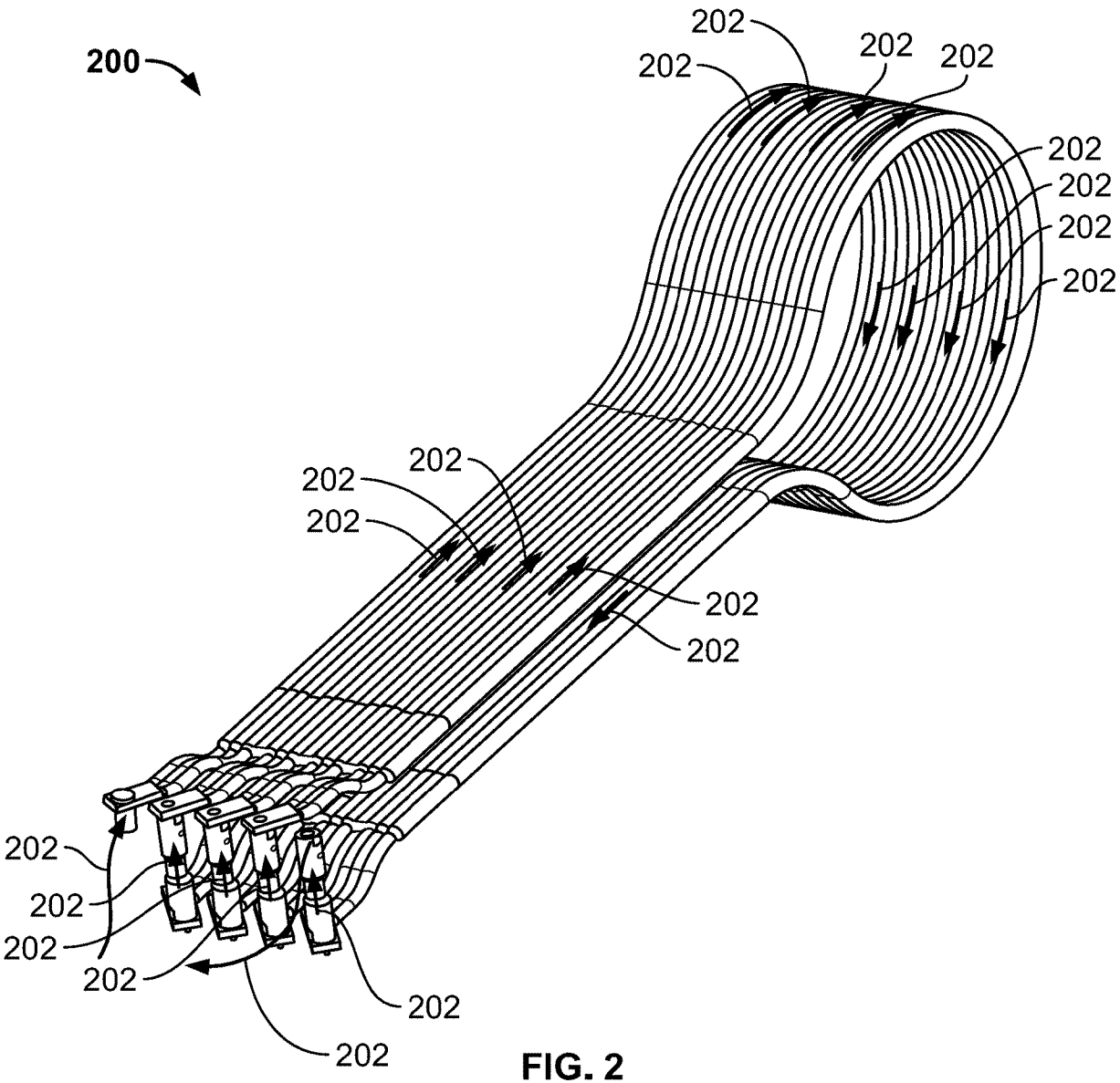
FIG. 2 is a perspective view of an example set of conductors configured as an inductor with multiple turns for use as an induction heating blanket, in accordance with aspects of this disclosure.

FIG. 2 is a perspective view of an example set of conductors 200 configured as an inductor having multiple turns, for use as an induction heating blanket. The example conductors 200 of FIG. 2 may be used to implement the induction heating coil 106. The conductors 200 are physically arranged in parallel, but are electrically connected in parallel by a turn connector to direct the current through the conductors 200 in the same direction. Current lines 202 are shown in FIG. 2 to illustrate how current flows through the conductors 200.

The example conductors 200 of FIG. 2 may be electrically connected in parallel groups to reduce resistive losses and to improve the magnetic coupling between the conductors 200 and the workpiece 108. For example, the conductors 200 of FIG. 2 are connected in four groups of three conductors each. Each of the four groups is terminated using a same termination at the turn connector for connection to an adjacent group of the conductors and/or to the induction heating power supply 104.

Figure 3:
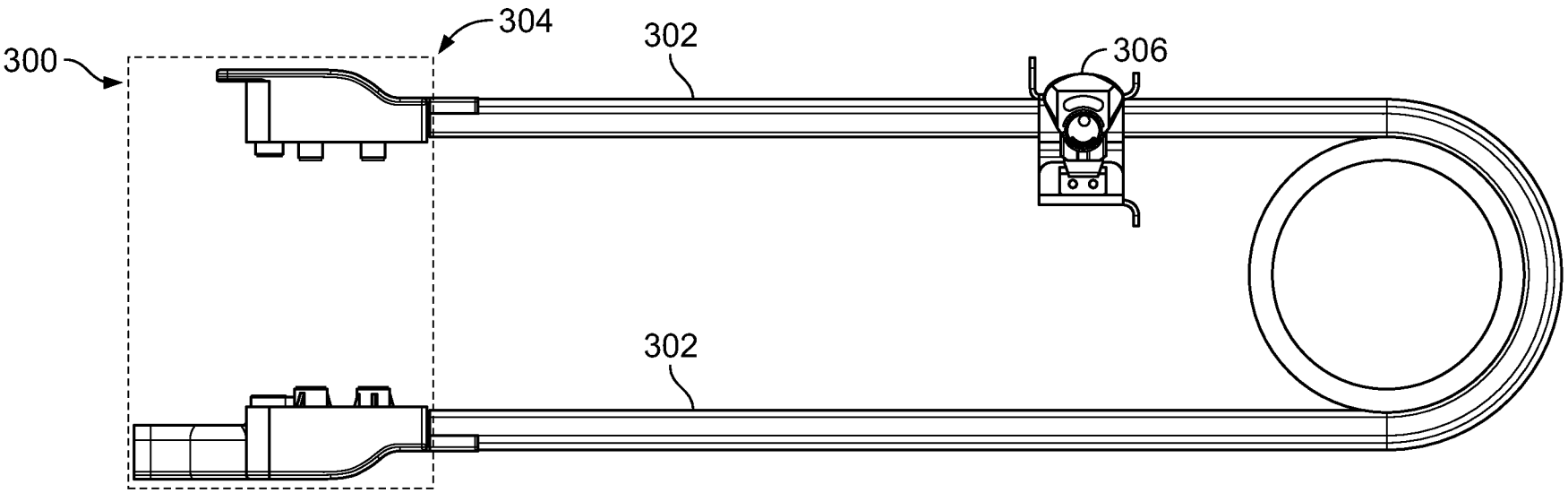
FIG. 3 illustrates an example induction heating assembly prior to installation around a workpiece to be inductively heated, in accordance with aspects of this disclosure.
Figure 4A:
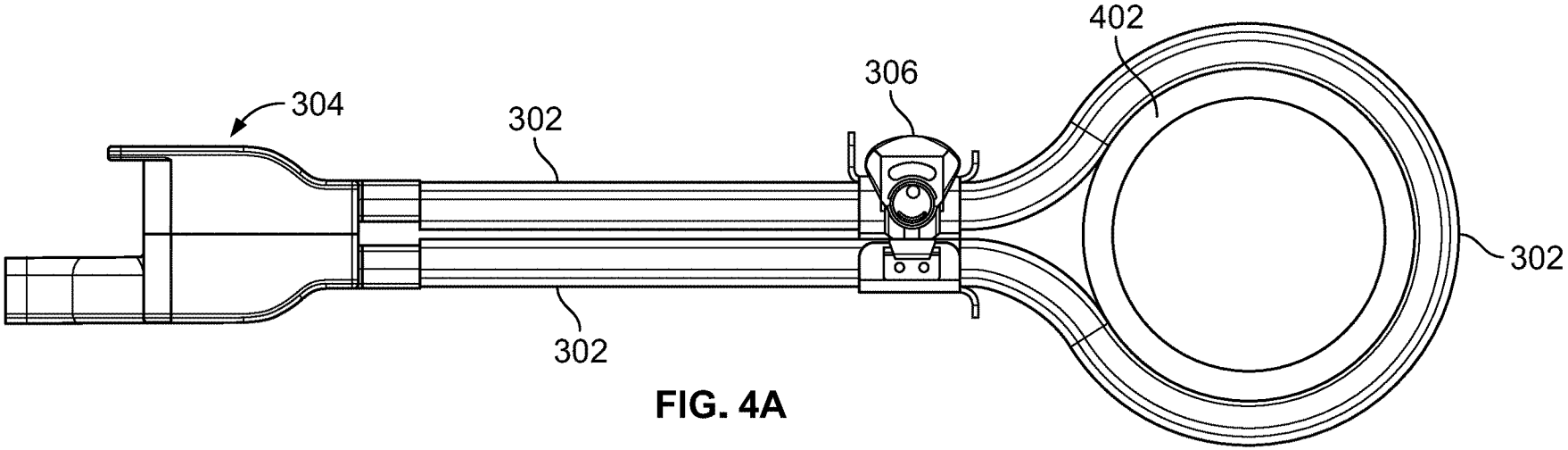
FIGS. 4A and 4B illustrate the induction heating assembly of FIG. 3 in different installations for inductively heating pipes having different diameters.
Figure 4B:
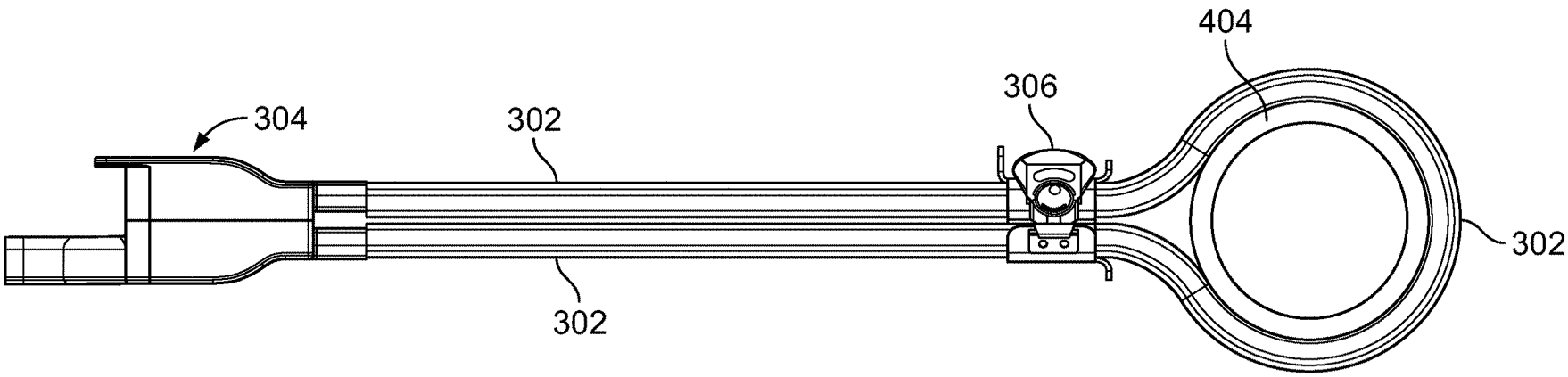
Figure 5:
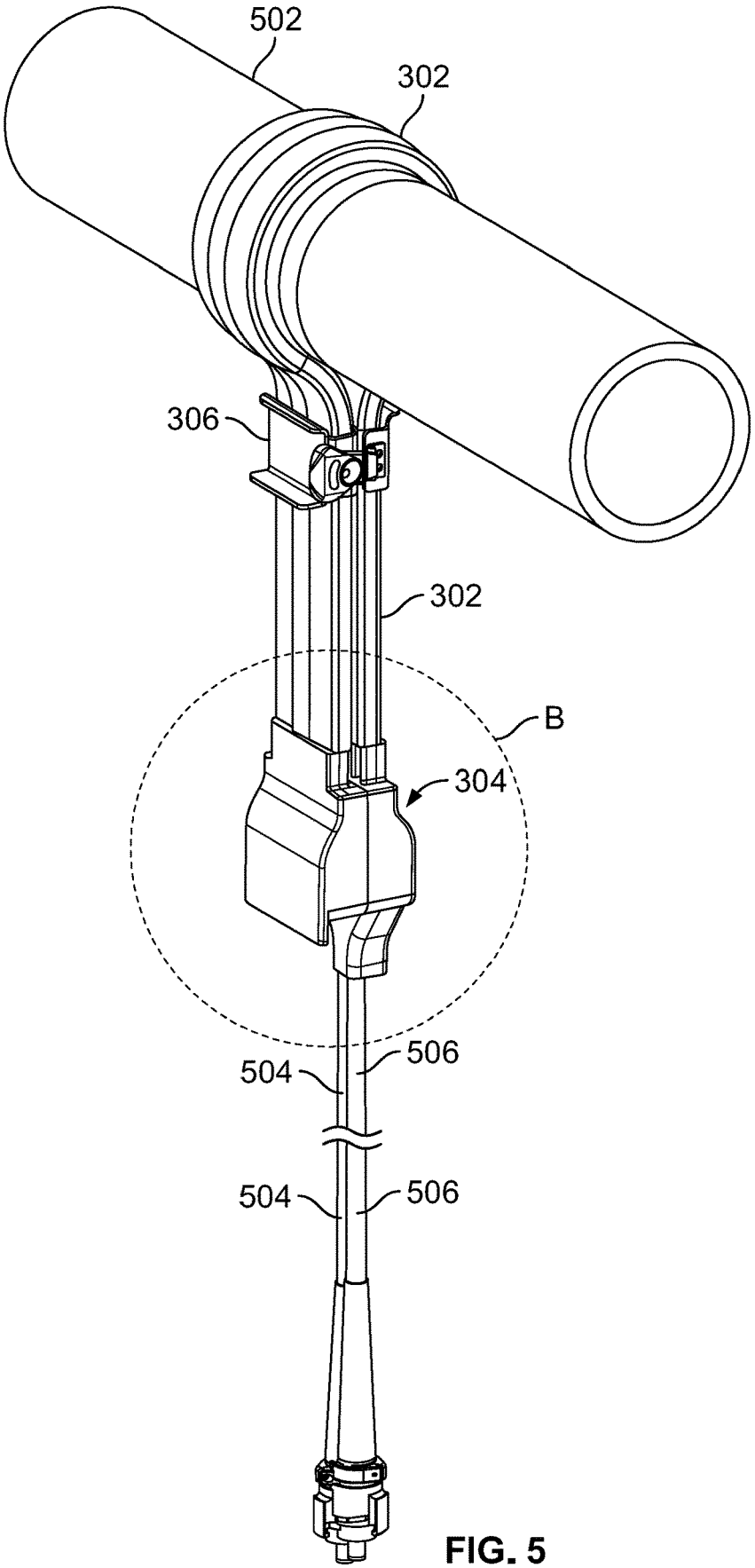
FIG. 5 is a perspective view of the example induction heating assembly of FIG. 3 installed around a pipe.
Figure 6:
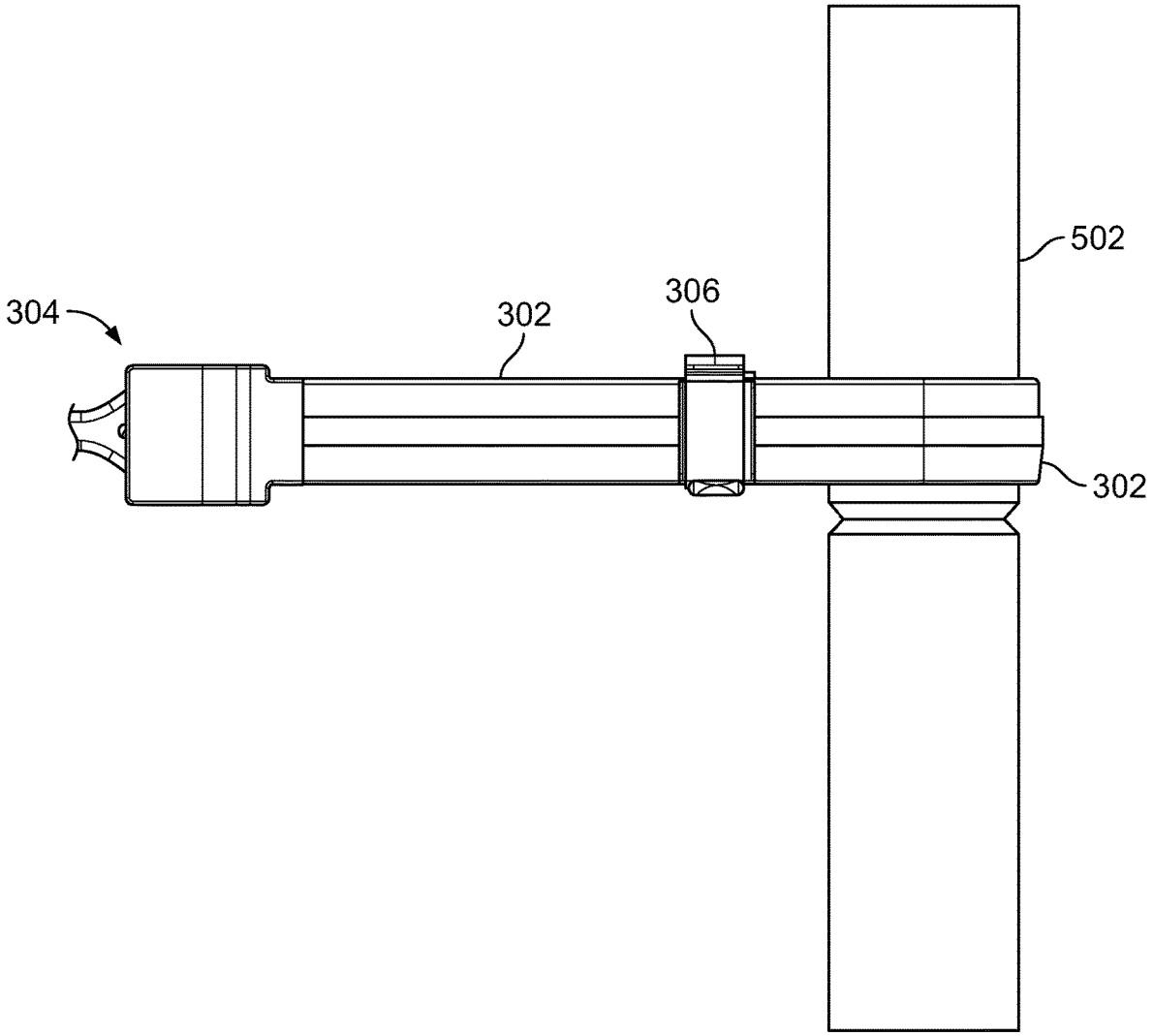
FIG. 6 is a plan view of the example induction heating assembly of FIG. 3 installed around a pipe.

FIG. 3 illustrates an example induction heating apparatus 300 prior to installation around a workpiece to be inductively heated. FIGS. 4A and 4B illustrate the induction heating apparatus 300 of FIG. 3 in different installations for inductively heating pipes 402, 404 having different diameters. FIG. 5 is a perspective view of the example induction heating apparatus 300 of FIG. 3 installed around a pipe 502. FIG. 6 is a plan view of the example induction heating apparatus 300 of FIGS. 3 and 5 installed around the pipe 502. The induction heating apparatus 300 is an example implementation of the induction heating coil 106 of FIG. 1. The example workpiece 502 is a pipe, but may be another type of object for which induction heating may be desired (or required by code).

The example induction heating apparatus 300 includes multiple conductors (e.g., the conductors 200 illustrated in FIG. 2), which are covered by a jacket 302 or other type of cover. The apparatus 300 further includes a turn connector 304 and an adjustment clamp 306.

The jacket 302 is a flexible thermal insulation that protects the conductors from heat radiating from the workpiece and/or from physical damage. In some examples, the jacket 302 includes a flap that permits the conductors 200 to be inserted and removed from an interior of the jacket 302. The jacket 302 may experience substantial physical wear or damage in some applications, so the jacket 302 may be replaced when the jacket 302 is no longer capable of providing adequate protection for the conductors 200 inside the jacket 302.

The adjustment clamp 306 is configured to conform the conductors 200 to a workpiece to increase (e.g., maximize) magnetic coupling between the conductors 200 and the workpiece. Thus, the adjustment clamp 306 enables the induction heating apparatus 300 to be used to heat workpieces of different sizes (e.g., pipes within a range of diameters) while providing acceptable magnetic coupling. The example pipe 402 of FIG. 4A has a first diameter (e.g., 12 inches) and the pipe 404 of FIG. 4B has a second diameter (e.g., 8 inches). The induction heating apparatus 300 may be conformably wrapped around each of the pipes 402, 404, and the adjustment clamp 306 clamps the jacket 302 near the pipe 402, 404 to tighten the jacket 302 and the conductors 200 against the pipe 402, 404, to thereby increase the coupling between the conductors 200 inside the jacket 302 and the pipe 402, 404.

Because a shorter length of the jacket 302 and the conductors 200 is needed to wrap around the smaller diameter pipe 404, a longer length of the jacket 302 and the conductors 200 extend between the adjustment clamp 306 and the turn connector 304. In this manner, the example induction heating apparatus 300 may be used for a range of workpiece sizes (e.g., a range of pipe diameters). However, an operator wraps the jacket 302 and the conductors 200 around different size workpieces, assembles the turn connector 304, and connects the adjustment clamp 306 in substantially the same way regardless of the size of the workpiece.

The example induction heating apparatus 300 may be positioned around workpieces such that a longitudinal center of the apparatus 300 is a contact point for all workpiece sizes within the designated range of the apparatus 300 (e.g., based on a length of the conductors 200 connected to the turn connector 304). The consistent point of contact enables a consistent location for placement of thermocouples on the blanket and, thus, a faster setup than if thermocouple placement was required to be decided at each installation. One or more thermocouples may be embedded within the apparatus 300, such as within the outer insulation layer of the blanket (as described below with reference to FIGS. 11A-11D), on an exterior of the blanket, and/or in any other location on the apparatus 300. For example, one or more thermocouples may be configured to measure the temperature of the workpiece (e.g., at the lengthwise center of the blanket that provide the consistent point of contact with the workpiece) and/or the temperature of one or more of the conductors 200. The one or more thermocouples have leads, which may exit the blanket near the point of measurement and/or may be embedded in the blanket from the point of measurement to or near the turn connector 304.

FIG. 5 also illustrates an example extension cable 504 and a supply connector 506 to couple the induction heating coil 106 to the induction heating power supply 104. The example extension cable 504 may be hardwired to the turn connector 304 and/or detachable from the turn connector 304 to enable replacement of the extension cable 504, the turn connector 304, and/or the induction heating coil 106. The supply connector 506 connects the extension cable 504 to the induction heating power supply 104.

As shown in FIG. 6, the induction heating apparatus 300 may be positioned adjacent a seam in the pipe 502 that is to be welded. For example, welding codes may require that a pipe joint be heated to a particular temperature range prior to welding of the joint. In the examples of FIGS. 4A, 4B, 5, and 6, the induction heating apparatus 300 is positioned around a circumference of the pipe 502 and in physical conformance (with the exception of a small portion of the circumference adjacent the adjustment clamp).

Figure 7:
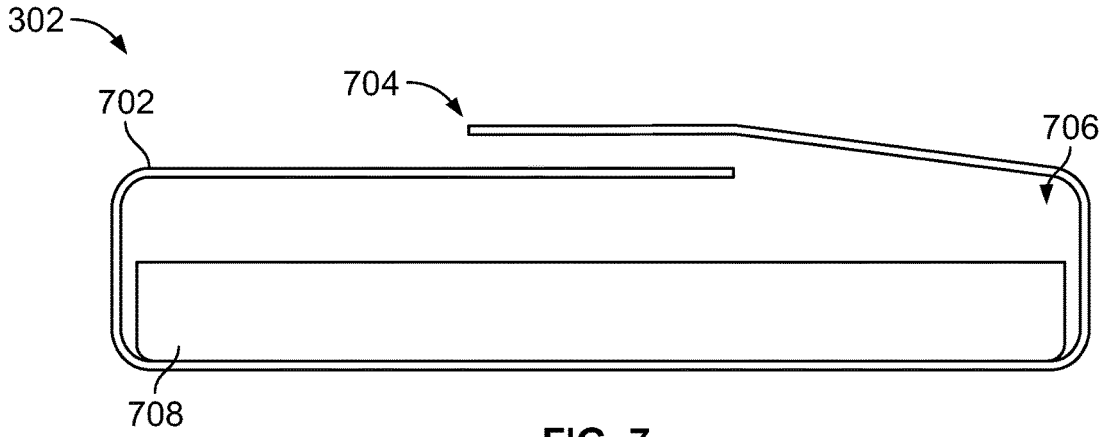
FIG. 7 is a cross-section view of the example jacket of FIG. 3.

FIG. 7 is a cross-section view of the example jacket 302 of FIG. 3. As illustrated in FIG. 7, the jacket 302 includes an outer cover 702 having a flap 704 to enable insertion and removal of the conductors 200 into a cavity 706 within the outer cover 702. The flap 704 retains the conductors 200 within the cavity 706 until intentional removal of the conductors 200 via the flap 704.

In the example of FIG. 7, the jacket 302 further includes a thermal insulation layer 708 positioned between the conductors 200 in the cavity 706 and a workpiece being heated. The thickness of the thermal insulation layer 708 is inversely proportional to the magnetic coupling between the conductors 200 and the workpiece and, therefore, affects the amount of induction heating power that can be transferred from the conductors 200 to the workpiece. While a thinner thermal insulation layer 708 improves magnetic coupling and power transfer, a thinner layer also reduces resistance to thermal transfer to the conductors 200. An optimal thickness of the thermal insulation layer 708 depends on the induction heating power being transferred to the workpiece, the material(s) used in the outer cover 702 and/or the thermal insulation layer 708, and/or the materials used to construct and/or encapsulate the conductors 200. Additionally, the target workpiece temperature affects the selected thickness of the insulation layer 708. Higher target workpiece temperatures are achievable using a thicker insulation layer 708 and/or by using liquid cooling of the conductors 200 instead of air cooling.

Figure 8A:
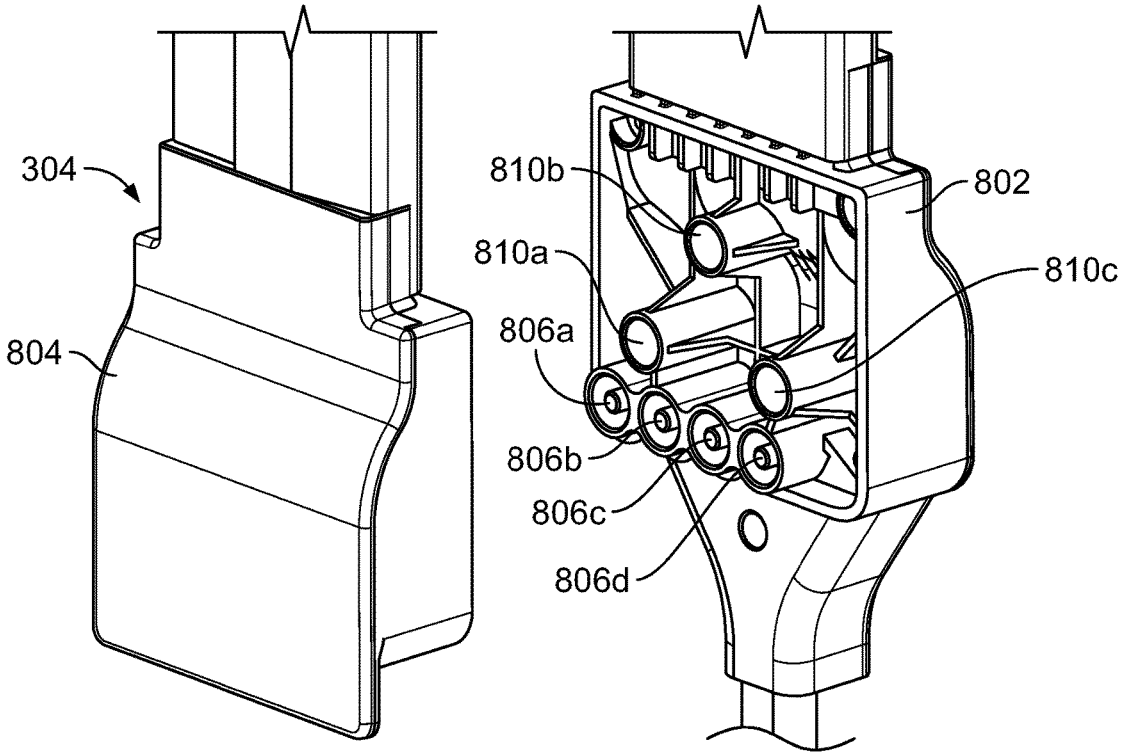
FIGS. 8A and 8B illustrate perspective views of the turn connector of FIG. 3.
Figure 8B:
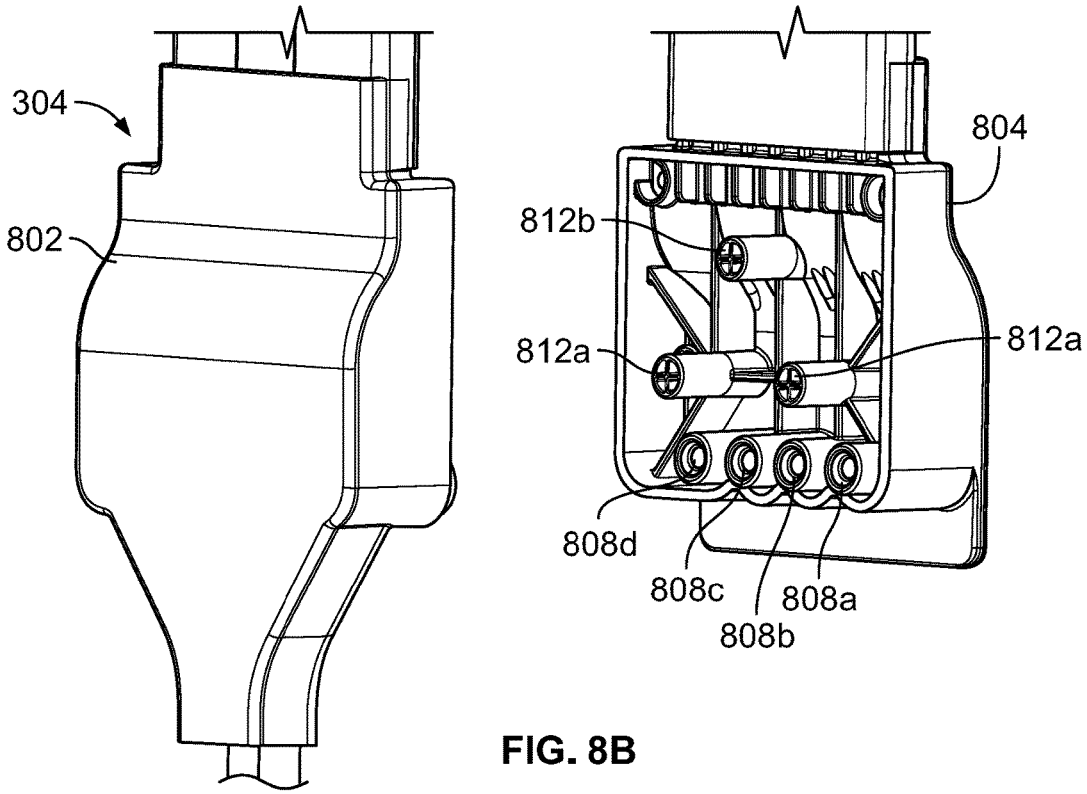

FIGS. 8A and 8B illustrate perspective views of the turn connector 304 of FIG. 3. The example turn connector 304 includes a first connector 802 and a second connector 804. The first connector 802 and the second connector 804 can be connected to form a closed loop and disconnected to break the loop. For example, the first connector 802 and the second connector 804 are disconnected to enable a user to wrap the induction heating coil 106 around a workpiece. As shown in FIGS. 8A and 8B, the input and output cables to the coil 106 are on the same connector (e.g., the first connector 802), which enables the opposite end of the coil 106 from the first connector 802 (e.g., the end of the coil 106 attached to the second connector 804) to be wrapped around a workpiece without having to also route the input lead and/or the output lead around the workpiece.

Depending on the number of conductors in the induction heating coil 106 and/or the configuration of the turn connector 304, the turn connector 304 enables a user to wrap multiple turns of an induction coil around the workpiece substantially simultaneously by wrapping the induction heating coil 106 around the workpiece as a single unit. For example, a single action or series of actions by an operator results in the conductors and the jacket being wrapped around the workpiece at the same time. In other words, an action that results in one of the conductors and/or the cover being wrapped around the workpiece also results in the other conductors and/or the cover being wrapped around the workpiece.

As illustrated in FIG. 8A, the first connector 802 includes current transfer connectors 806*a*, 806*b*, 806*c*, 806*d* that are electrically connected to corresponding groups of the conductors 200 in the induction heating coil 106. As illustrated in FIG. 8B, the second connector 804 includes current transfer connectors 808*a*, 808*b*, 808*c*, 808*d* that are electrically connected to opposite ends of the groups of the conductors 200 from the current transfer connectors 806*a*, 806*b*, 806*c*, 806*d*. When the first connector 802 and the second connector 804 are attached, the current transfer connectors 808*a*, 808*b*, 808*c*, 808*d* make contact with the current transfer connectors 806*a*, 806*b*, 806*c*, 806*d* to form multiple turns of an inductor corresponding to the number of conductors (or groups of electrically parallel conductors) in the induction heating coil 106. In the example of FIGS. 8A and 8B, there are four pairs of current transfer connectors 806*a*-806*d*, 808*a*-808*d* to form four turns.

The first connector 802 also includes alignment posts 810*a*, 810*b*, 810*c*. The second connector 804 includes corresponding alignment posts 812*a*, 812*b*, 812*c*. The alignment posts 810*a*-810*c* mate with the alignment posts 812*a*-812*c* when the first connector 802 is coupled to the second connector 804, and prevent rotation between the first connector 802 and the second connector 804.

Figure 9:
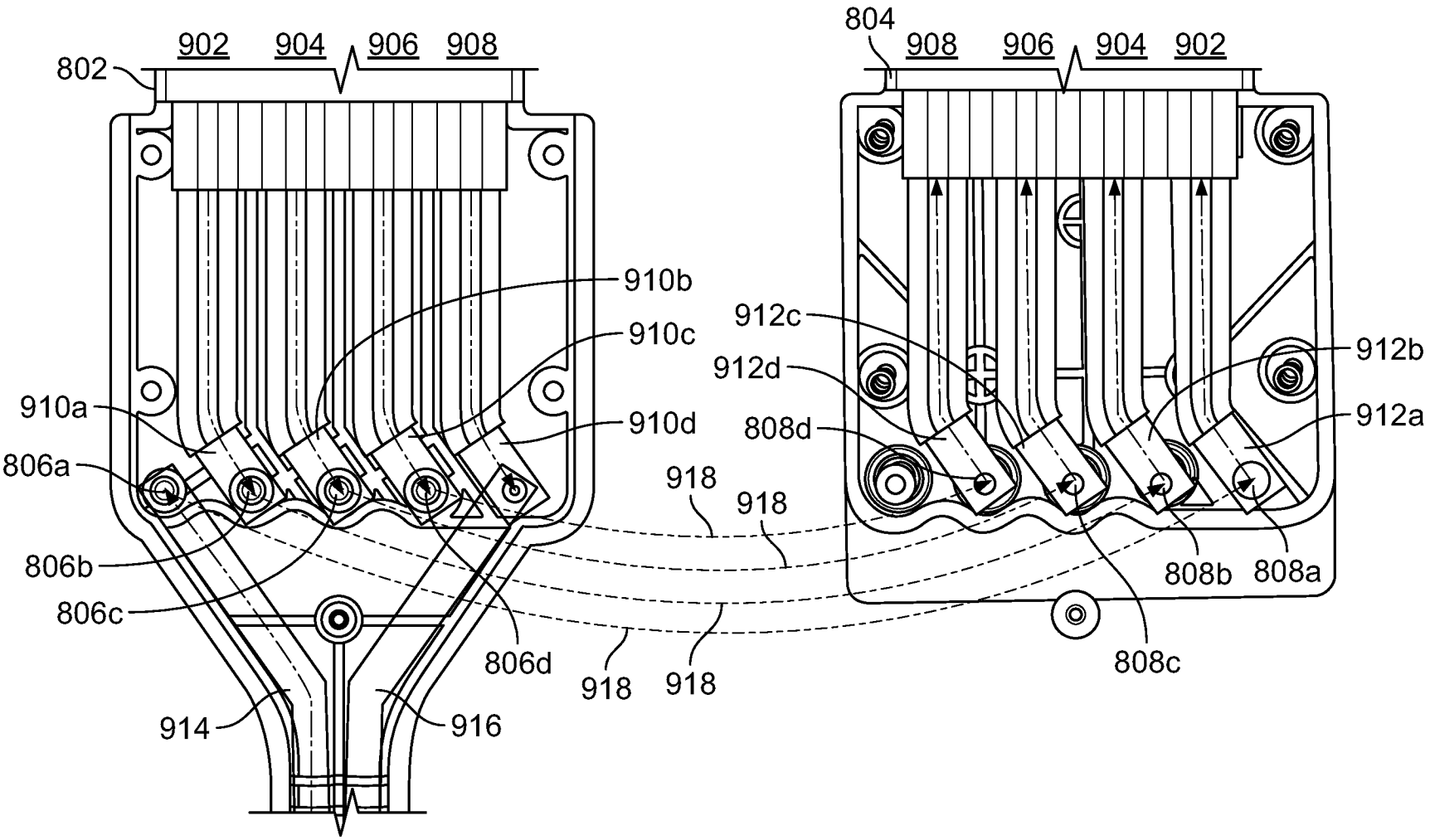
FIG. 9 illustrates cross-section plan views of the example turn connector of FIG. 3 and an example current path to configure multiple physically parallel conductors of an induction heating blanket electrically in series to form multiple turns.

FIG. 9 illustrates cross-section plan views of the example turn connector 304 of FIG. 3 (e.g., the first connector 802 and the second connector 804 of FIGS. 8A and 8B). Portions of the first and second connectors 802, 804 are shown removed from FIG. 9 to illustrate the physical routing of the example groups of conductors 902, 904, 906, 908 within the turn connector 304.

Each of the groups of conductors 902-908 includes three parallel Litz cables. Using the parallel Litz cables (e.g., instead of one larger equivalent Litz cable) improves the magnetic coupling between the groups of conductors 902-908 and the workpiece. The use of Litz cables maintains a consistent spacing between turns of the resulting inductor.

In some other examples, the three parallel Litz cables are replaced with more or fewer Litz cables having rectangular cross-sections, non-Litz cables, and/or any other type of cable capable of magnetically coupling to the workpiece.

Each of the example groups of conductors 902-908 is terminated on both ends (e.g., using terminations to enable connection to the current transfer connectors 806*a*-806*d*, 808*a*-808*d*. For example, the group of conductors 902 is terminated at the first connector 802 by a first termination 910*a* connected to the current transfer connector 806*b* and at the second connector 804 by a second termination 912*a* connected to the current transfer connector 808*a*. The group of conductors 904 is terminated at the first connector 802 by a first termination 910*b* connected to the current transfer connector 806*c* and at the second connector 804 by a second termination 912*b* connected to the current transfer connector 808*b*. The group of conductors 906 is terminated at the first connector 802 by a first termination 910*c* connected to the current transfer connector 806*d* and at the second connector 804 by a second termination 912*c* connected to the current transfer connector 808*c*. The group of conductors 908 is terminated at the first connector 802 by a first termination 910*d* and at the second connector 804 by a second termination 912*d* connected to the current transfer connector 808*d*.

The first connector 802 is also connected to the supply cables 914, 916 that provide the induction heating power from the induction heating power supply 104 to the groups of conductors 902-908. The supply cable 914 is coupled to the current transfer connector 806*a*, and the supply cable 916 is coupled to the termination 910*d*.

An example current path 918 is illustrated in FIG. 9 to show the flow of current through the conductors 902-908 when the turn connector 304 is connected, so as to configure multiple physically parallel conductors of an induction heating blanket electrically in series to form multiple turns. The current path 918 is shown in a unidirectional manner in FIG. 9, but current flow may be bidirectional (e.g., using AC current) and/or unidirectional in the opposite direction of the illustrated current path 918. As shown by the current path 918, induction heating current flows through the following components, in order: the supply cable 914, the current transfer connector 806*a*, the current transfer connector 808*a*, the termination 912*a*, the group of conductors 902, the termination 910*a*, the current transfer connector 806*b*, the current transfer connector 808*b*, the termination 912*b*, the group of conductors 904, the termination 910*b*, the current transfer connector 806*c*, the current transfer connector 808*c*, the termination 912*c*, the group of conductors 906, the termination 910*c*, the current transfer connector 806*d*, the current transfer connector 808*d*, the termination 912*d*, the group of conductors 908, the termination 910*d*, and the supply cable 916.

Figure 10:
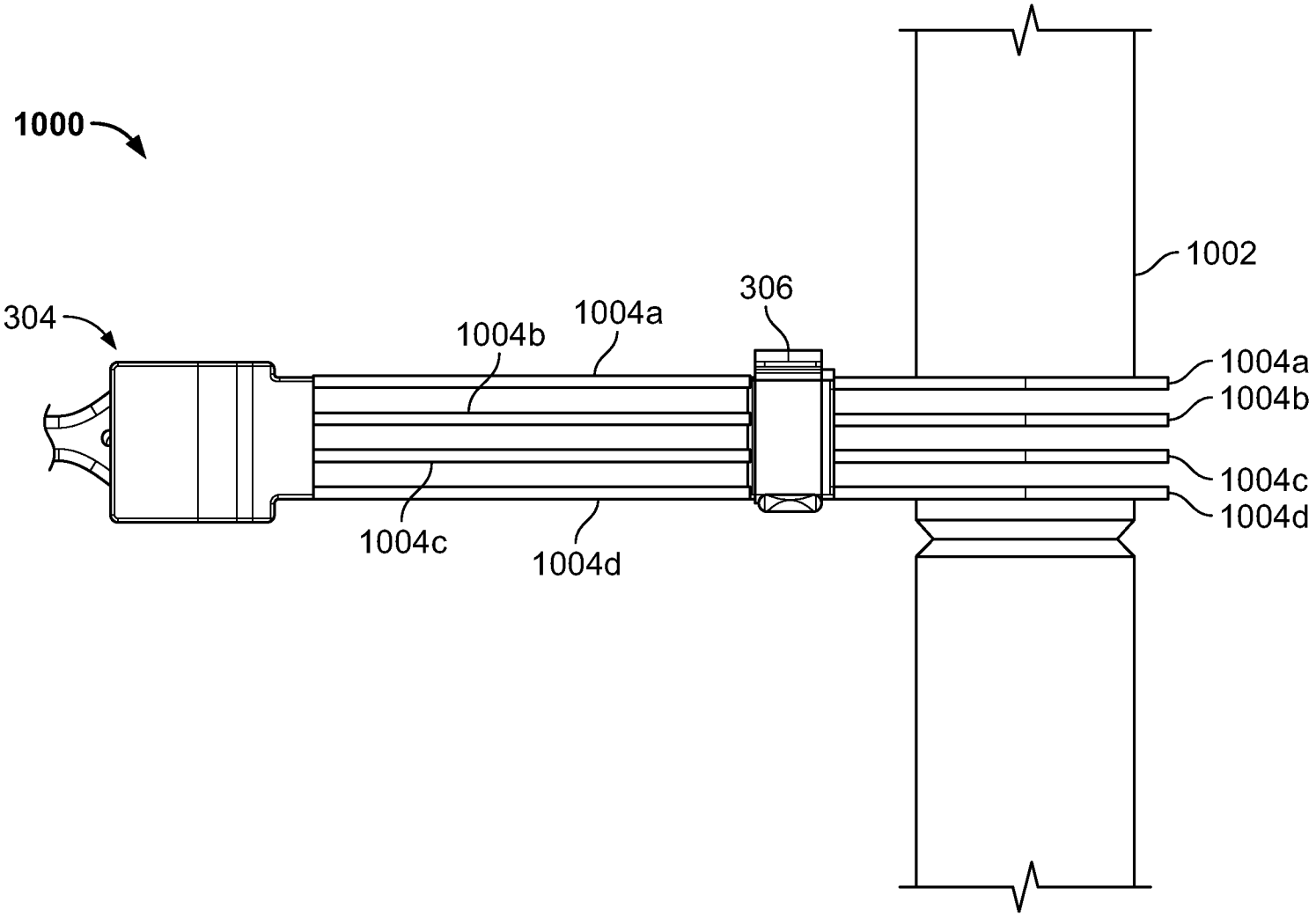
FIG. 10 is a plan view of another example induction heating assembly installed around a pipe, in which the turn connector connects multiple physically separate conductors to form multiple turns of an induction coil.

In some other examples, instead of being connected to blanket including the multiple groups of conductors 902-908, the turn connector 304 may be used to connect multiple, physically separate conductors (or groups of conductors that are physically separate from each other) to form multiple turns. FIG. 10 is a plan view of another example induction heating assembly 1000 installed around a pipe 1002, in which the turn connector 304 connects multiple physically separate conductors to form multiple turns of an induction coil. Instead of a blanket including multiple conductors, the example assembly 1000 includes physically separate conductors 1004*a*-1004*d*, which are connected via the turn connector 304 to form multiple turns of an induction heating coil. Like the example induction heating apparatus 300 described above, the example conductors 1004*a*-1004*d* of the example assembly 1000 may be more easily positioned around the pipe 1002 and removed from the pipe 1002 than a single conductor of equivalent length to form the same number of turns. The example conductors 1004*a*-1004*d* may be individually insulated and/or combined into a same insulative jacket.

Example arrangements of conductors used with the turn connector 304 are disclosed and described herein. However, other arrangements of single conductors, groups of conductors, and/or blankets may be used.

Figure 11A:
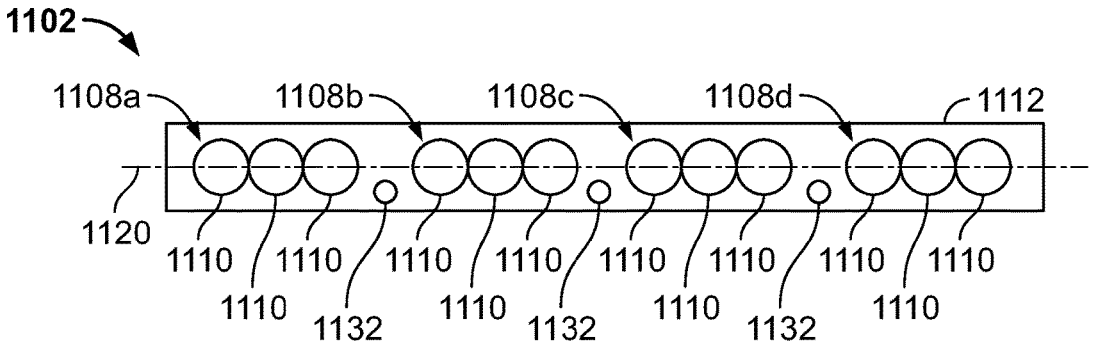
FIGS. 11A, 11B, 11C, and 11D are cross sections of example induction heating blankets including multiple sets of conductors, which may be used to implement the sets of conductors of FIG. 2.
Figure 11B:
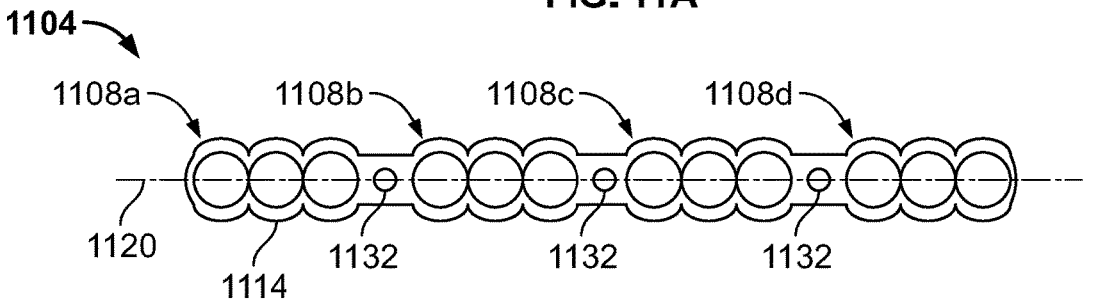
Figure 11C:
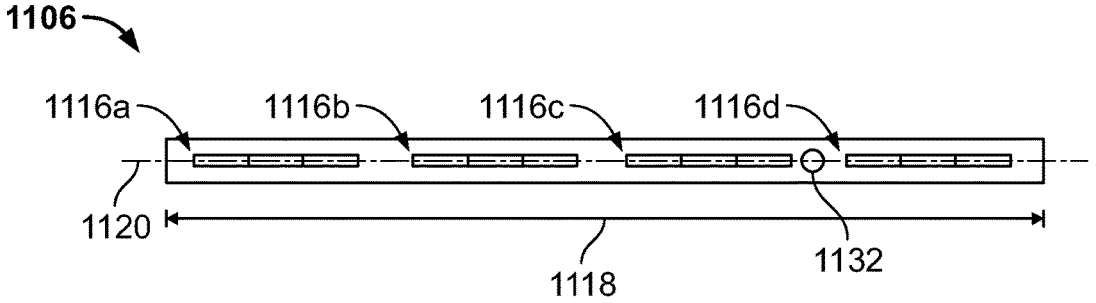

FIGS. 11A, 11B, and 11C are cross sections of example induction heating assemblies 1102, 1104, 1106 including multiple sets of cables, which may be used to implement the sets of conductors 200 of FIG. 2. In each of the example assemblies 1102-1106, the groups of cables extend substantially in parallel directions (e.g., all of the cables in the assembly 1102-1106 extend along in parallel along a same plane). The use of multiple conductors per turn in the example planar orientations of FIGS. 11A-11C (as well as FIGS. 2, 8A, 8B, 9A, and 9B) reduces (e.g., minimizes) coupling distances between the conductors and the part to increase (e.g., maximize) a width of the heat affected area in the workpiece.

In the example of FIG. 11A, the induction heating assembly 1102 includes multiple groups of cables 1108*a*, 1108*b*, 1108*c*, 1108*d*. Each of the example groups of cables 1108*a*-1108*d* includes multiple cables. In some examples, inner layers of insulation 1110 provide electrical insulation between the cables in each of the groups 1108*a*-1108*d*. For example, the cables may be jacketed cables. Additionally, when the individual cables in a group of cables 1108*a*-1108*d* are Litz cables, individual conductor strands and/or subcombinations of individual conductors strands of the cables making up the Litz cable are electrically insulated.

An outer layer of insulation 1112 insulates the groups of cables 1108*a*-1108*d* from heat and electrical contact (e.g., with the workpiece). The example outer layer of insulation 1112 may be cast over the groups of cables 1108*a*-1108*d*, and/or the groups of cables 1108*a*-1108*d* may be extruded through the insulation material to form the outer layer of insulation 1112.

In the example of FIG. 11B, the induction heating assembly 1104 includes similar groups of cables 1108*a*-1108*d* as in FIG. 11A. In contrast with the outer insulation 1112 of FIG. 11A, the example induction heating assembly 1104 has outer insulation 1114 that conforms more closely to the individual groups of cables 1108*a*-1108*d*, and extends between the groups of cables 1108*a*-1108*d* to form a single assembly (e.g., instead of physically separate cables and/or groups). As a result, the outer insulation 1114 has a first thickness at locations where the outer insulation 1114 is adjacent the groups of cables 1108*a*-1108*d* and has a second thickness where the outer insulation 1114 extends between the groups of cables 1108*a*-1108*d*.

In the example of FIG. 11C, the induction heating assembly 1106 includes cables that have a flatter cross-section than the cables in the assemblies 1102 and 1104. The cables of FIG. 11C are arranged into groups of cables 1116*a*-1116*d*. By having a flatter cross-section of the cables with a same (or similar) cross-sectional area for each individual conductor, the example groups of cables 1116*a*-1116*d* have an improved magnetic coupling to the workpiece and an improved transfer of heat. The example induction heating assembly 1106 may have a thinner profile in a direction perpendicular to the plane of the cables and the assembly 1106, but a wider profile across the cross-section along a direction 1118.

As shown in each of FIGS. 11A-11C, the groups of cables (or cables) extend along a same plane 1120. By aligning the cables along the plane 1120, the cables have a higher magnetic coupling and/or induction heating power transfer to a workpiece than if the cables are out of alignment with the plane 1120 (e.g., at different distances from the workpiece) when the workpiece is adjacent the assembly 1102, 1104, 1106 parallel to the plane 1120.

Figure 11D:
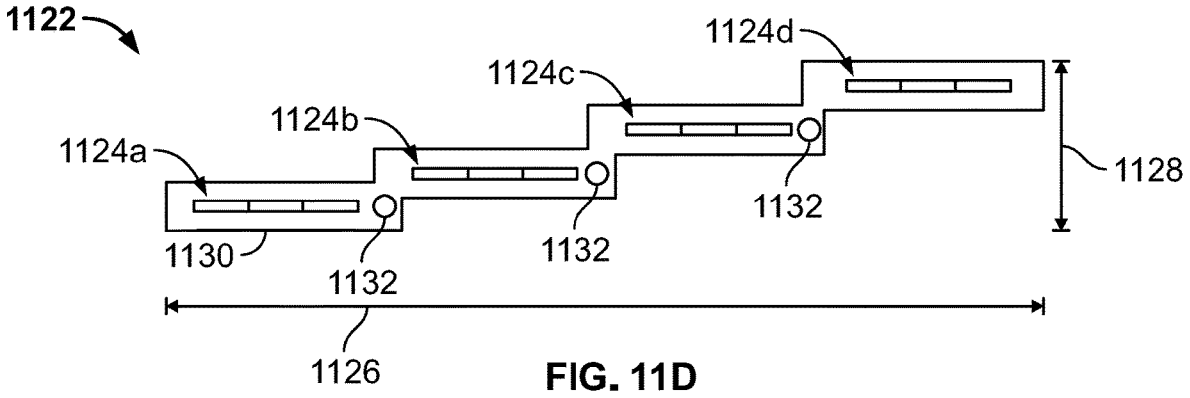

FIG. 11D is another example induction heating assembly 1122 in which sets of conductors 1124*a*-1124*d* are physically offset or non-planar in their arrangement. In the example of FIG. 11D, each of the sets of one or more conductors 1124*a*-1124*d* is oriented in a first direction 1126. The groups of conductors 1124*a*-1124*d* are offset from adjacent groups 1124*a*-1124*d* in a second direction 1128. An outer insulation layer 1130 is formed in the first direction 1126 and the second direction 1128 according to the desired groupings of conductors and the offsets between the groups.

The arrangement of the induction heating assembly 1122 of FIG. 11D may provide improved magnetic coupling between the groups of conductors 1124*a*-1124*d* than achievable using the blankets 1102-1106 when used for inductively heating a non-planar surface, such as a flange and/or a T-joint. The offsets between the groups of conductors 1124*a*-1124*d* may improve the conformance of the induction heating assembly 1122 to the non-planar workpiece by, for example, being easier to bend and/or more closely matching the joint geometry to the arrangement of the groups of conductors 1124*a*-1124*d*.

Example assemblies, insulation, and conductor geometries and groupings are illustrated in FIGS. 11A-11D. However, any other outer insulation geometry, conductor geometry, conductor grouping (or lack of grouping), spacing, dimensions, and/or any other aspects of the assembly may be modified. Cables may have smaller or larger cross-sectional areas (e.g., using ribbonized Litz cables) to improve power delivery by the induction heating assembly for different workpiece sizes (e.g., different pipe diameters). Example induction heating cable assemblies include multiple groups of one or more cables extending substantially in parallel along a plane, and an insulation layer that both insulates the groups of cables and extends between the groups of cables to form a single assembly. The example groups of cables 1108*a*-1108*d* and/or the outer insulation may stack the cables and/or the groups of cables in a direction perpendicular to the plane of contact with the workpiece (e.g., stacking away from the workpiece) to concentrate inductive heating in a narrower heating zone. The construction of example assemblies (e.g., the groups of cables and the outer insulation) enable the cables to be wrapped around the workpiece simultaneously (e.g., by wrapping the two ends of the assembly around the workpiece), instead of wrapping a single conductor around the workpiece multiple times.

The cables in the groups of cables may be Litz cables, non-Litz cables, or a combination of Litz and non-Litz cables. The Litz cables and/or non-Litz cables in the groups of cables may have circular cross-sections, rectangular cross-sections (e.g., where the longer dimension extends parallel to a surface that is to contact a workpiece), and/or any other cross-section shape. The cables and/or the groups may be aligned along a same plane such that each of the cables in the group and/or in the assembly are a same distance from the workpiece when the assembly is in conformance with the workpiece. In some examples, the groups extend along a plane and one or more of the cables in a group are removed from the plane such that the cables are at different distances from the workpiece when the assembly is in conformance with the workpiece.

In some examples, the cables and/or the insulation layer are constructed and/or assembled with step(s), curve(s), and/or another non-planar geometry over the cross-section of the cables and/or the insulation layer. A non-planar geometry across the cross-section improves conformity of the conductors and/or the insulation layer around non-planar workpiece surfaces to be heated, such as step(s) for tapered flanges and/or curve(s) for flange faces.

The cables and the outer insulation may be extruded, the cables may be cast into the outer insulation, and/or any other appropriate method of construction may be used. In some examples, the outer insulation 1112 is silicone or another electrically and/or thermally insulative (or thermally conductive) material which is also conformable to the workpiece.

In the examples of FIGS. 11A-11D, the proximal ends of the groups of cables are adjacent one another and the distal ends of the groups of cables are adjacent one another. With respect to the cross-sections of the assemblies 1102, 1104, 1106, 1122 shown in FIGS. 11A-11D, the groups of cables extend lengthwise in a first direction (e.g., into and/or out of the cross-section) and are adjacent in a second direction (e.g., across the width of the assemblies. 1102, 1104, 1106, 1122. Additionally, in the example of FIG. 11D, the groups of conductors 1124*a*-1124*d* are offset one another in a third direction with respect to the cross-section of the assembly 1122 (e.g., in the illustrated direction 1128).

While the examples of FIGS. 11A-11D illustrate the cables as clustered within the groups of cables 1108*a*-1108*d* and different groups of cables distanced from adjacent groups of cables 1108*a*-1108*d*, in other examples the individual cables in the groups of cables 1108*a*-1108*d* are spaced farther apart, spaced a same distance apart as the groups of cables 1108*a*-1108*d* are spaced, uniformly spaced across the cross-section of the assemblies 1102-1106, and/or have any other desired spacing(s) and/or offset(s).

In each of FIGS. 11A-11D, example thermocouple leads 1132 are shown within the outer insulation layers 1112, 1114, 1130. The thermocouples attach to the thermocouple leads 1132 may measure a temperature of one or more of the conductors and/or a temperature of the workpiece.

Figure 13:
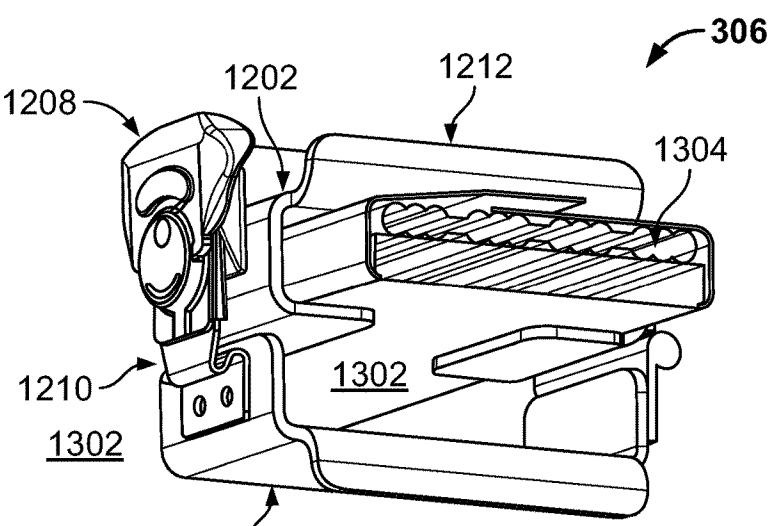
FIG. 13 is a view of the example adjustment clamp of FIG. 12 including a first portion of an induction heating blanket.
Figure 12:
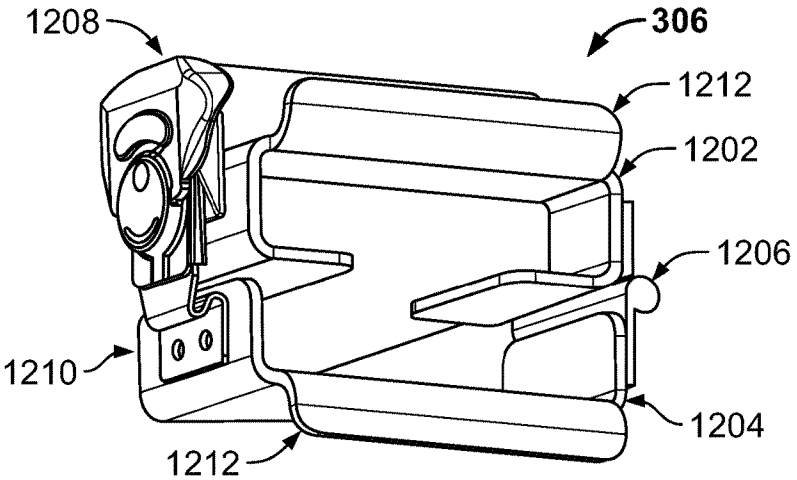
FIG. 12 is a more detailed view of an example adjustment clamp.
Figure 14:
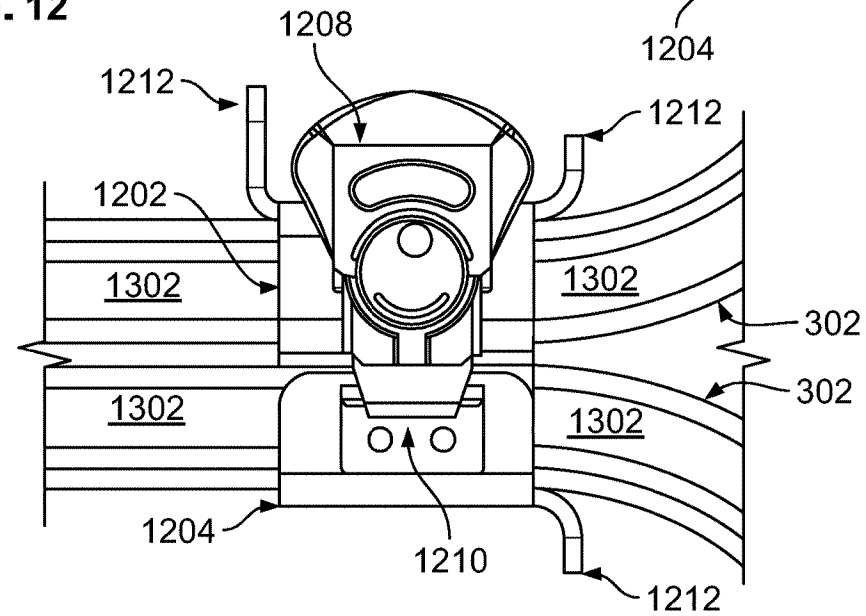
FIG. 14 is a side view of the example adjustment clamp of FIG. 12 in which the adjustment clamp is clamping the induction heating blanket to conform the conductors in the induction heating blanket to a workpiece.

FIG. 12 is a more detailed view of the example adjustment clamp 306 of FIG. 3. FIG. 13 is a view of the example adjustment clamp 306 of FIG. 12 including a first portion of an induction heating blanket 1302. The induction heating blanket 1302 of FIG. 13 includes an induction heating assembly 1304 (e.g., the induction heating assembly 1104 of FIG. 11B) inside of the jacket 302 of FIG. 3. FIG. 14 is a side view of the example adjustment clamp 306 of FIG. 12 in which the adjustment clamp 306 is clamping the induction heating blanket 1302 to conform the conductors in the induction heating blanket 1302 to a workpiece.

The example adjustment clamp 306 of FIG. 12 includes a first bracket 1202, a second bracket 1204, a hinge 1206, and a latch 1208.

The first bracket 1202 holds the induction heating blanket 1302 at a first location along the length of the induction heating blanket 1302. In the example of FIG. 12, the first bracket 1202 applies a slight or moderate compressive force to the induction heating blanket 1302 to reduce or prevent inadvertent movement of the first bracket 1202 along the length of the induction heating blanket 1302. In some examples, a material of the first bracket 1202 and/or the material of the jacket 302 provide a sufficient coefficient of friction to reduce inadvertent movement between the first bracket 1202 and the jacket 302. The second bracket 1204 is a C-bracket into which a second portion of the induction heating blanket 1302 can be inserted (e.g., after the induction heating blanket 1302 is wrapped around a workpiece). In some examples, the first bracket 1202 is also a C-bracket (e.g., omits the wings of the first bracket 1202 illustrated in FIG. 12).

The hinge 1206 rotatably couples the first and second brackets 1202, 1204. The hinge 1206 enables the clamp 306 to be opened to receive a second portion of the blanket 1302 in the second bracket 1204. In the example of FIG. 12, the hinge 1206 and the second bracket 1204 are dimensioned and coupled to the first bracket 1202 such that, when the blanket 1302 is placed into the second bracket 1204 and the clamp 306 is closed, the first and second brackets 1202, 1204 compress the portion of the blanket 1302 in the second bracket 1204 to clamp the blanket 1302 in place around a workpiece.

The latch 1208 is configured to latch or otherwise lock the clamp 306 to hold the induction heating blanket 1302 in place around a workpiece. To improve the magnetic coupling between the induction heating blanket 1302 and the workpiece, the clamp 306 and/or the induction heating blanket 1302 may be positioned to tightly compress the induction heating blanket 1302 around the workpiece (e.g., by positioning the clamp 306 as close to the workpiece as possible or practical for the operator). The example latch 1208 may have a tightening feature to enable an operator to first close the latch 1208 (e.g., around a hook 1210) and then increase the compression force by tightening the latch 1208.

To reduce or prevent damage to the jacket 302 by the clamp 306 resulting from angles between the induction heating blanket 1302 and the clamp 306, the example first and second brackets 1202, 1204 include shoulders 1212 (or other features) to avoid abrasion on the jacket 302 from edges or exterior corners on the first and second brackets 1202, 1204.

The example latch 1208 of FIGS. 12-14 may be replaced with any other type of consumable and/or nonconsumable fastening mechanism, such as a clasp, a ratchet, a clamp, a hook-and-eye closure, a zip tie, a strap or rope and cleat, and/or any other fastener.

Figure 15A:
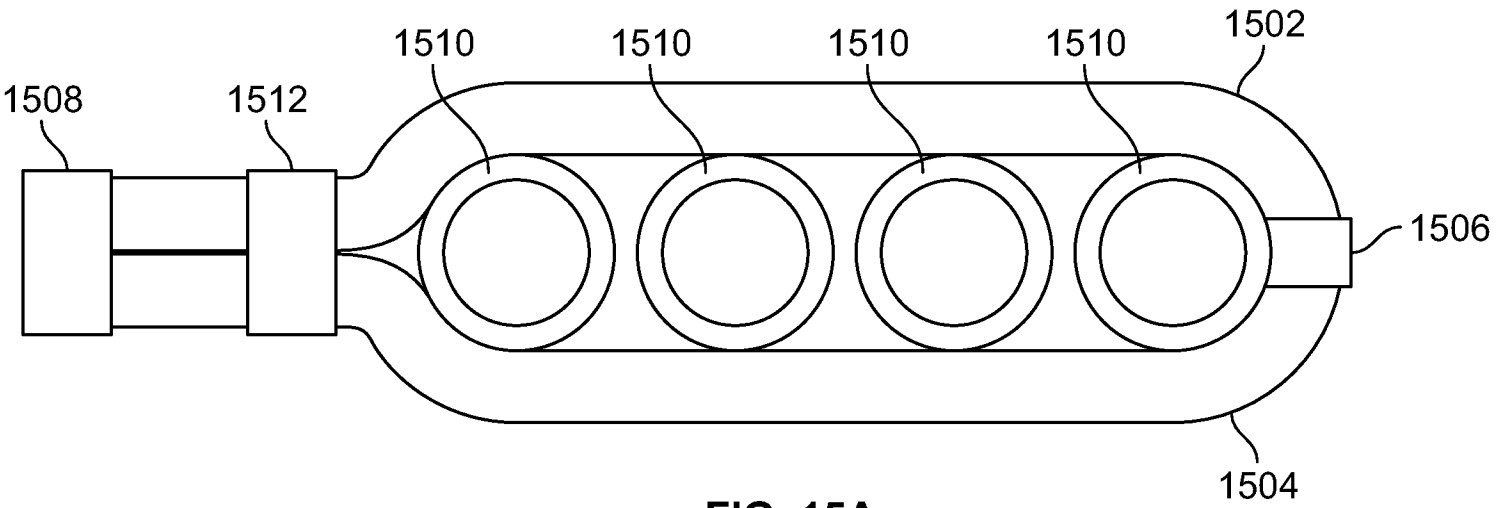
FIGS. 15A and 15B illustrate example configurations of one or more induction heating blankets arranged to inductively heat multiple workpieces simultaneously.
Figure 15B:
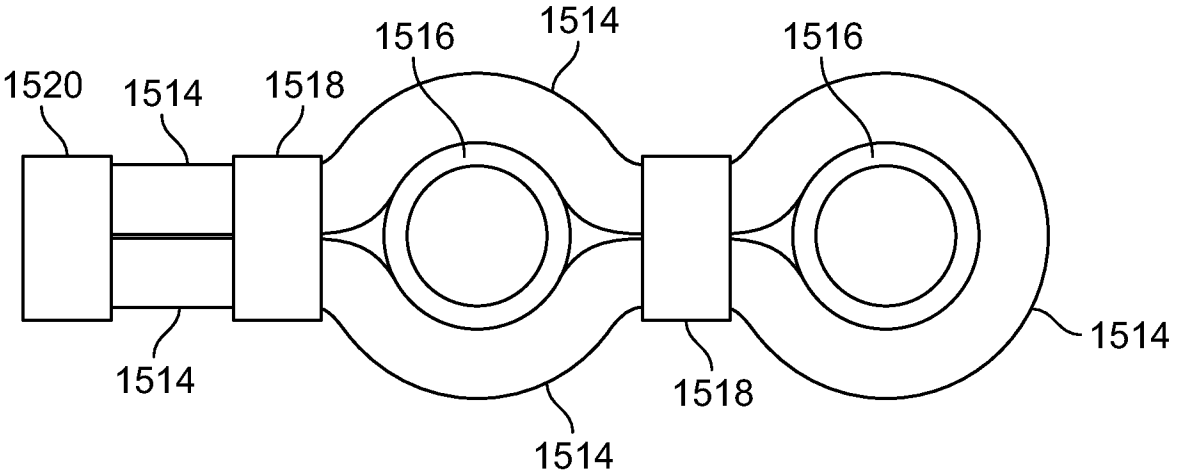

FIGS. 15A and 15B illustrate example configurations of one or more induction heating blankets arranged to inductively heat multiple workpieces simultaneously. In the example of FIG. 15A, two induction heating blankets 1502, 1504 are coupled together using an extension connector 1506 and a turn connector 1508 (e.g., the turn connector 304 of FIGS. 3, 8A, 8B, 9A, and 9B). The example extension connector 1506 connects conductors or cables of the first blanket to corresponding conductors or cables of the second blanket to extend the length of the blanket to fit multiple workpieces 1510 simultaneously. After the induction heating blankets 1502, 1504 are connected via the extension connector 1506 and wrapped around the workpieces 1510, an adjustment clamp 1512 may be secured to hold the induction heating blankets 1502, 1504 in position to heat the workpieces 1510. In some examples, a second adjustment clamp may be used opposite the adjustment clamp 1512.

In the example of FIG. 15B, an induction heating blanket 1514 is wrapped around multiple workpieces 1516, and two adjustment clamps 1518 provide increased magnetic coupling between the induction heating blanket 1514 and the workpieces 1516 (e.g., relative to the magnetic coupling in the example of FIG. 15A). The induction heating blanket 1514 is connected to form multiple turns by a turn connector 1520.

Figure 16A:
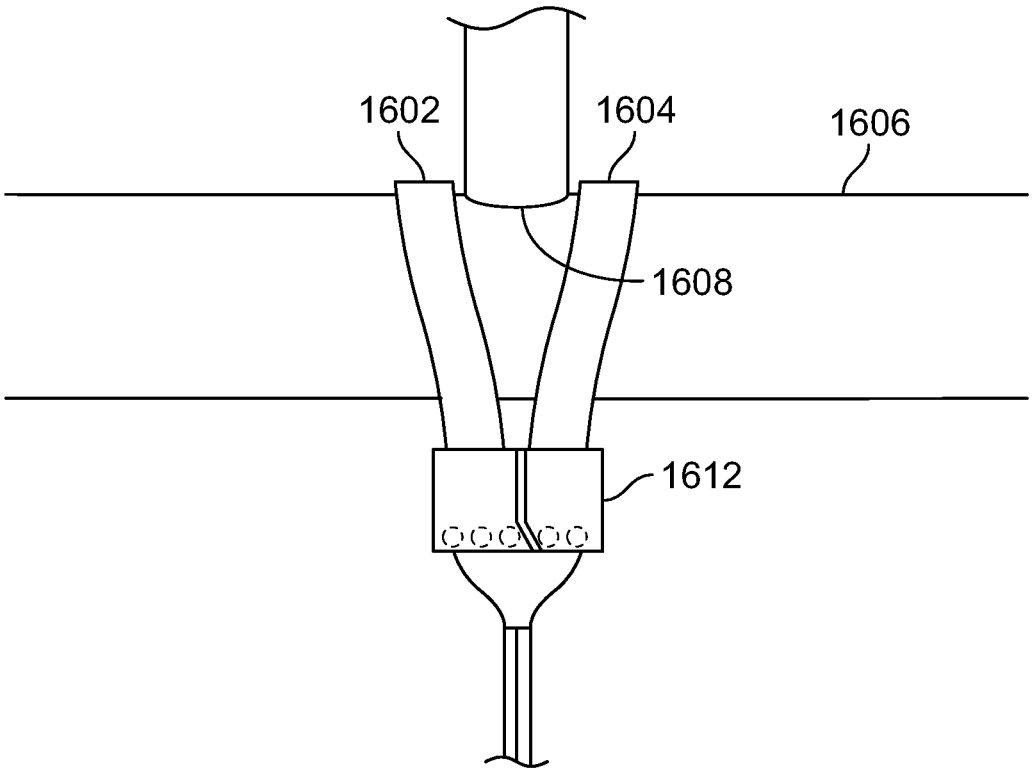
FIGS. 16A and 16B illustrate views of another example configuration of induction heating blankets arranged to inductively heat a workpiece.
Figure 16B:
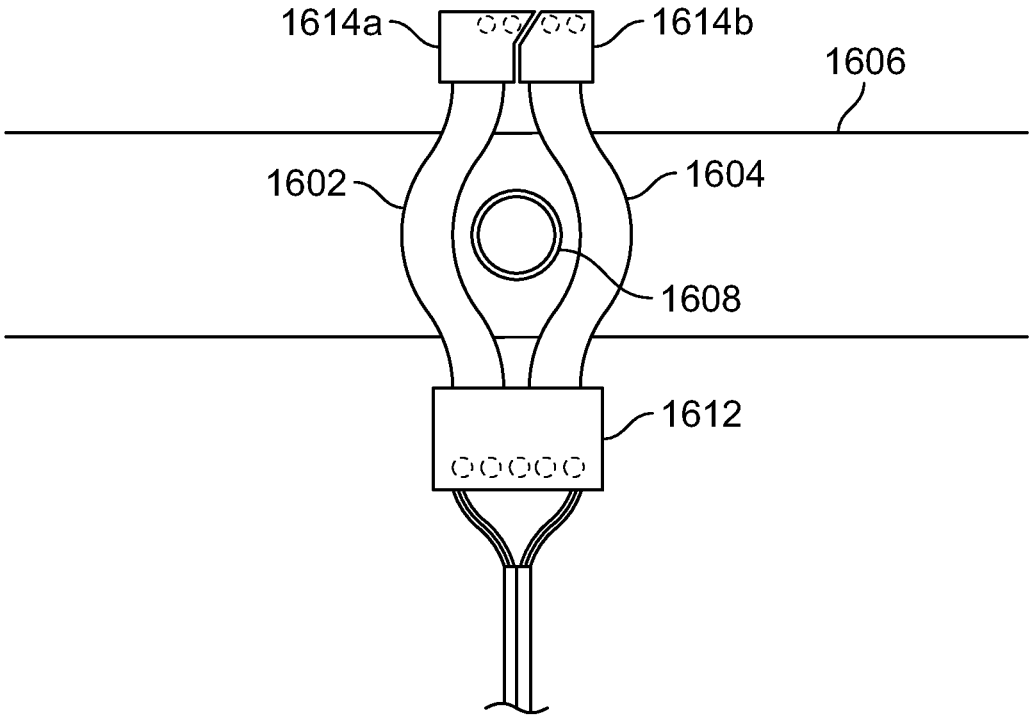

FIGS. 16A and 16B illustrate views of another example configuration of induction heating blankets 1602, 1604 arranged to inductively heat a workpiece 1606. The example workpiece 1606 includes a T-joint 1608, which is a non-planar joint. The example induction heating blankets 1602, 1604 are used in conjunction to heat both sides of the joint 1608, which may provide improved heating relative to conventional techniques and/or relative to a single induction heating blanket as disclosed herein.

The multiple induction heating blankets 1602, 1604 are connected by a turn connector 1610 to form a single inductor having multiple turns (e.g., up to the total number of conductors in the blankets 1602, 1604). A first portion 1612 of the turn connector 1610 is connected to both of the blankets 1602, 1604. Each of the blankets 1602, 1604 is provided with a separate second connector 1614*a*, 1614*b* (e.g., two identical connectors) so that the blankets 1602, 1604 can be wrapped on different sides of the joint 1608 and removed from the joint 1608. Each of the example second connectors 1614*a*, 1614*b* connects the end of the corresponding blanket 1602, 1604 (e.g., the conductors in the blanket 1602, 1604) to the first portion 1612 of the turn connector 1610 to form multiple turns, in a similar or identical manner as described above with reference to FIGS. 8A, 8B, 9A, and 9B. The example first connector 802 may be used to implement the first part 1612 of the turn connector 1610, while the second connectors 1614*a*, 1614*b* may be implemented in a manner similar to the second connector 804 to make the contacts with the first part 1612.

Figure 17:
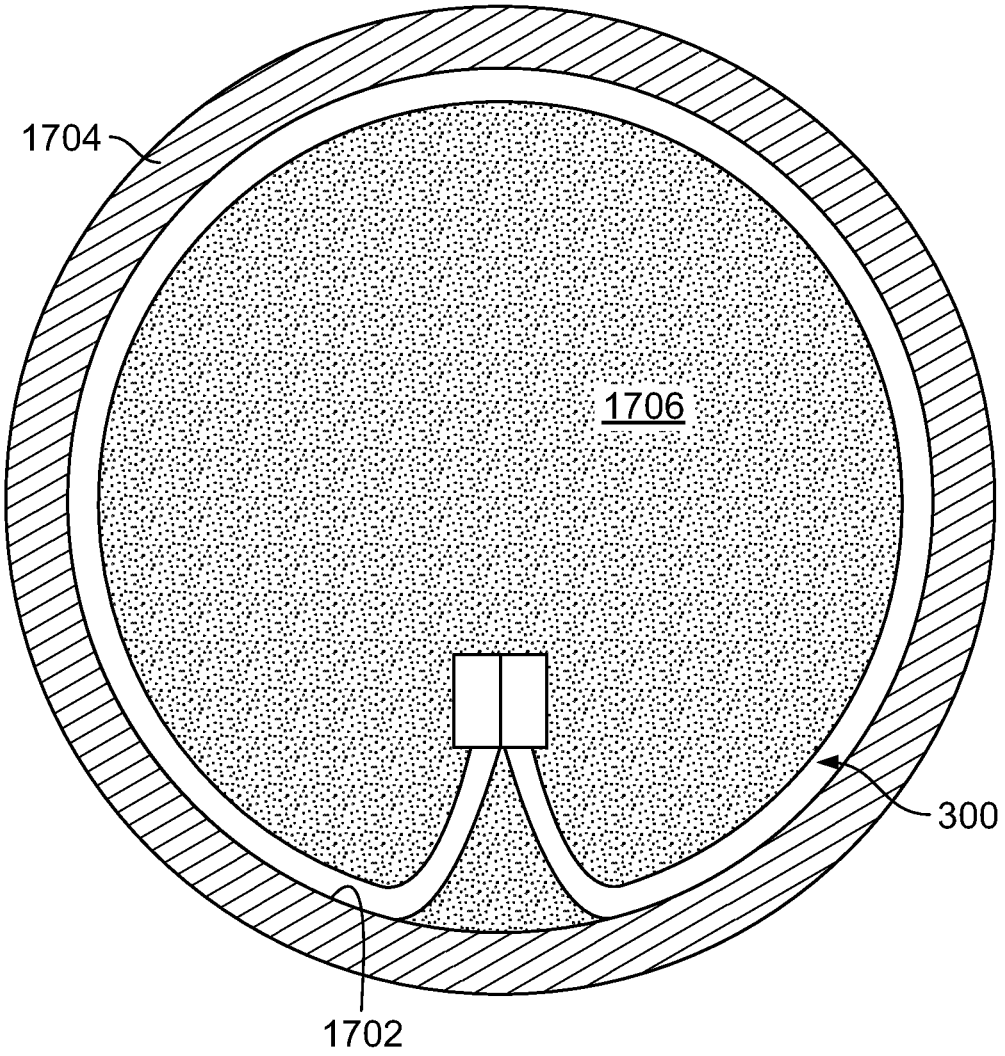
FIG. 17 illustrates the induction heating assembly of FIG. 3 in an installation on an interior surface of a pipe for inductively heating the pipe.

FIG. 17 illustrates the induction heating assembly 300 of FIG. 3 in an installation on an interior surface 1702 of a pipe 1704 for inductively heating the pipe 1704. As illustrated in FIG. 17, the induction heating assembly 300 may be arranged in conformance with the interior surface 1702 to magnetically couple the induction heating assembly 300 to the pipe 1704. The same type of induction heating assembly 300 may be used for both interior surfaces and exterior surfaces of a workpiece.

The example induction heating assembly 300 may be arranged in conformance with the pipe 1704 (or other type of workpiece) with the assistance of a brace 1706 or other type of device to hold the conductors against the interior surface 1702. An example brace 1706 may include an inflatable dam that can be inflated to push the conductors of the induction heating assembly 300 toward the interior surface 1702. However, other types of braces may be used to support the conductors.

Figure 18:
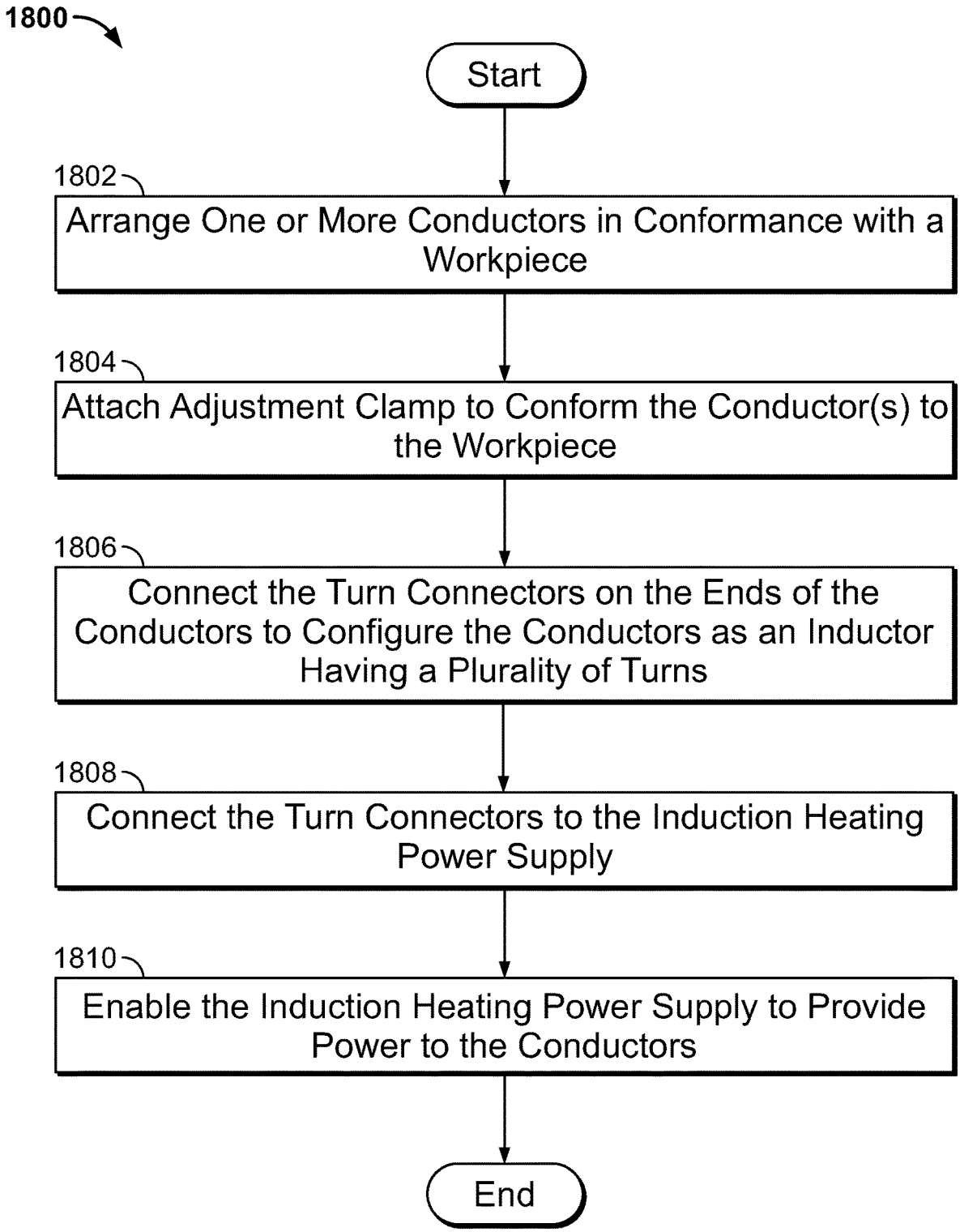
FIG. 18 is a flowchart representative of an example method to heat a workpiece using an induction heating blanket and an induction heating power supply, in accordance with aspects of this disclosure.

FIG. 18 is a flowchart representative of an example method 1800 to heat a workpiece using an induction heating blanket and an induction heating power supply.

At block 1802, an operator arrange one or more conductors in conformance with a workpiece (e.g., the workpiece 108 of FIG. 1). The one or more conductors may include physically separate conductors (e.g., the conductors 1004*a*-1004*d* of FIG. 10), one of the induction heating assemblies 1102-1106 of FIGS. 11A-11C, and/or any other induction heating assembly and/or arrangement of conductors. Referring to the example induction heating apparatus 300 of FIG. 3, a user may simultaneously wrap multiple conductors enclosed in the jacket 302 around the workpiece 108 by wrapping the jacket 302 around the workpiece 108. In other examples, the user may simultaneously arrange multiple conductors enclosed in the jacket 302 in conformance with an interior surface of the workpiece 108.

At block 1804, the operator attaches the adjustment clamp 306 to conform the conductors to the workpiece 108. In examples in which the size of the workpiece 108 requires the full length (or nearly the full length) of the conductors, block 1804 may be omitted. The adjustment clamp 306 may tighten the conductors against an exterior of the workpiece 108 and/or push the conductors against an interior of the workpiece 108.

At block 1806, the operator connects the first and second connectors 802, 804 of the turn connector 304 on the ends of the conductors (e.g., the conductor groups 902-908) to configure the conductors as an inductor having multiple turns. In the example of FIGS. 9A and 9B, the turn connector 304 configures the conductors as four turns of an inductor.

At block 1808, the operator connects the turn connector 304 to an induction heating power supply (e.g., the power supply 104 of FIG. 1).

At block 1810, the operator enables the induction heating power supply 104 to provide power to the conductors to heat the workpiece 108. In some examples, the operator may specify a temperature or power level for heating the workpiece 108. Additionally or alternatively, the induction heating power supply 104 may detect one or more characteristics of the induction heating coil 106 (e.g., an inductance, a power capacity, etc.) and control one or more aspects of the induction heating power delivered to the induction heating coil 106 based on the identified characteristic(s). The example method 1800 may then end.

As utilized herein the terms "circuits" and "circuitry" refer to physical electronic components, any analog and/or digital components, power and/or control elements, such as a microprocessor or digital signal processor (DSP), or the like, including discrete and/or integrated components, or portions and/or combination thereof (i.e. hardware) and any software and/or firmware ("code") which may configure the hardware, be executed by the hardware, and or otherwise be associated with the hardware. As used herein, for example, a particular processor and memory may comprise a first "circuit" when executing a first one or more lines of code and may comprise a second "circuit" when executing a second one or more lines of code. As utilized herein, "and/or" means any one or more of the items in the list joined by "and/or". As an example, "x and/or y" means any element of the three-element set {(x), (y), (x, y)}. In other words, "x and/or y" means "one or both of x and y". As another example, "x, y, and/or z" means any element of the seven-element set {(x), (y), (z), (x, y), (x, z), (y, z), (x, y, z)}. In other words, "x, y and/or z" means "one or more of x, y and z". As utilized herein, the term "exemplary" means serving as a non-limiting example, instance, or illustration. As utilized herein, the terms "e.g.," and "for example" set off lists of one or more non-limiting examples, instances, or illustrations. As utilized herein, circuitry is "operable" to perform a function whenever the circuitry comprises the necessary hardware and code (if any is necessary) to perform the function, regardless of whether performance of the function is disabled or not enabled (e.g., by a user-configurable setting, factory trim, etc.).

While the present method and/or system has been described with reference to certain implementations, it will be understood by those skilled in the art that various changes may be made and equivalents may be substituted without departing from the scope of the present method and/or system. For example, block and/or components of disclosed examples may be combined, divided, re-arranged, and/or otherwise modified. In addition, many modifications may be made to adapt a particular situation or material to the teachings of the present disclosure without departing from its scope. Therefore, the present method and/or system are not limited to the particular implementations disclosed. Instead, the present method and/or system will include all implementations falling within the scope of the appended claims, both literally and under the doctrine of equivalents.

What is claimed is:

1. An induction heating apparatus, comprising:

a first conductor and a second conductor, configured to be arranged in conformance with a workpiece while the conductors are not electrically connected in series, wherein the first conductor and the second conductor are flexible so as to match the physical shape of the workpiece for a range of workpiece diameters; and a turn connector configured to:

connect the first and second conductors in series to configure the first and second conductors as an inductor having a plurality of turns; and arrange portions of the first and second conductors located between the turn connector and the workpiece to be adjacent.

2. The induction heating apparatus as defined in claim 1, further comprising an adjustment clamp configured to conform the first conductor and the second conductor to the workpiece.

3. The induction heating apparatus as defined in claim 2, wherein the adjustment clamp is configured to:

secure corresponding first points along the first conductor and the second conductor to corresponding second points along the first conductor and the second conductor; and enable at least one of adjustment of the first points along lengths of the first conductor and the second conductor or adjustment of the second points along the lengths of the first conductor and the second conductor, the locations of the first points and the second points determining lengths of the first conductor and the second conductor that can be conformed to the workpiece while securing the first points to the second points.

4. The induction heating apparatus as defined in claim 3, wherein the adjustment clamp is configured to enable the adjustment of the first points or the adjustment of the second points while the first points and the second points are not secured.

5. The induction heating apparatus as defined in claim 1, wherein the turn connector comprises:

a first connector configured to be connected to a first end of the first conductor and a first end of the second conductor; and a second connector configured to be connected to a second end of the first conductor and a second end of the second conductor, the turn connector configured to, when the first connector and the second connector are attached, connect the second end of the first conductor to a first end of the second conductor to place the first conductor and the second conductor in series.

6. The induction heating apparatus as defined in claim 5, wherein the first connector is configured to route the first conductor at least partially in a lateral direction toward the second conductor.

7. The induction heating apparatus as defined in claim 1, wherein the turn connector is configured to couple a first set of two or more conductors, including the first conductor, in parallel with each other to form a first one of the plurality of turns.

8. The induction heating apparatus as defined in claim 7, wherein the turn connector is configured to couple a second set of two or more conductors, including the second conductor, in parallel with each other and in series with the first set of conductors.

9. The induction heating apparatus as defined in claim 1, wherein the turn connector is configured to couple the first and second conductors to a power supply.

10. The induction heating apparatus as defined in claim 1, wherein the turn connector is configured to couple the first and second conductors such that current flows through the first and second conductors in a same direction.

11. The induction heating apparatus as defined in claim 1, further comprising a third conductor configured to be arranged in conformance with the workpiece to form a third turn of the inductor, the turn connector configured to connect the third conductor to the second conductor to place the third turn in series with the first and second turns.

12. The induction heating apparatus as defined in claim 1, further comprising a conductor holder configured to hold the first conductor and the second conductor such that the first conductor and the second conductor are arranged simultaneously with the conductor holder in conformance with the workpiece.

13. The induction heating apparatus as defined in claim 12, wherein the conductor holder comprises at least one of: a jacket configured to insulate the first conductor and the second conductor from the workpiece; a cable clasp configured to hold the first conductor within a range of distances from the second conductor; or a clamp configured to hold the first conductor at a first position relative to the second conductor.

14. The induction heating apparatus as defined in claim 12, wherein the conductor holder comprises a removable jacket into which the first and second conductors can be removably inserted.

15. The induction heating apparatus as defined in claim 12, wherein the conductor holder is configured to provide a substantially constant spacing between the plurality of turns.

16. The induction heating apparatus as defined in claim 12, wherein the conductor holder is configured to hold the first conductor and the second conductor a substantially constant distance from the workpiece.

17. The induction heating apparatus as defined in claim 1, further comprising an induction heating power supply configured to provide induction heating power to the plurality of turns.

18. The induction heating apparatus as defined in claim 1, wherein the first and second conductors are configured to be arranged in conformance with an exterior surface of the workpiece or an interior surface of the workpiece.

19. The induction heating apparatus as defined in claim 1, wherein the first conductor is a first Litz cable and the second conductor is a second Litz cable.

20. The induction heating apparatus as defined in claim 1, further comprising an extension connector configured to connect the first and second conductors to corresponding ones of a second set of conductors to extend a length of the induction heating apparatus.

* * * * *